US009279222B2

(12) United States Patent
Gerrits et al.

(10) Patent No.: US 9,279,222 B2
(45) **Date of Patent: *Mar. 8, 2016**

(54) SNOW THROWER IMPELLER

(75) Inventors: Samuel J. Gerrits, Pewaukee, WI (US); Daniel L. Steinike, West Bend, WI (US); James W. Mast, Sheboygan Falls, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 362 days.

This patent is subject to a terminal disclaimer.

(21) Appl. No.: 13/372,017

(22) Filed: Feb. 13, 2012

(65) Prior Publication Data

US 2012/0180346 A1 Jul. 19, 2012

Related U.S. Application Data

(63) Continuation-in-part of application No. 12/916,399, filed on Oct. 29, 2010, now Pat. No. 8,402,680.

(51) Int. Cl.
*E01H 5/09* (2006.01)
*E01H 5/04* (2006.01)

(52) U.S. Cl.
CPC ..... *E01H 5/045* (2013.01); *Y10T 29/49336* (2015.01)

(58) Field of Classification Search
CPC ..... E01H 5/045; E01H 5/076
USPC ..... 37/222, 233, 247, 251, 252, 256, 259, 37/260; 416/231 B, 234; 241/277, 278.1; 366/325.4, 328.3; D8/8; 172/13, 15; 30/347, 348, 351, 357; 56/295
See application file for complete search history.

(56) References Cited

U.S. PATENT DOCUMENTS

| | | | | | |
|---|---|---|---|---|---|
| 200,874 | A | * | 3/1878 | Robert | 416/234 |
| 1,186,880 | A | | 6/1916 | Canda | |
| 1,492,771 | A | * | 5/1924 | Adsit | E01H 5/076 37/256 |
| 1,781,960 | A | | 11/1930 | Schultz | |
| 2,076,975 | A | | 4/1937 | Bach | |
| 2,162,902 | A | | 6/1939 | Adams | |
| 2,352,127 | A | * | 6/1944 | Sheldon | 241/191 |
| 2,609,058 | A | | 9/1952 | Place | |
| 2,630,464 | A | | 3/1953 | Dunkelberger | |
| 2,908,337 | A | * | 10/1959 | Surprise et al. | 172/549 |
| 3,072,424 | A | | 1/1963 | Mayne et al. | |

(Continued)

FOREIGN PATENT DOCUMENTS

| | | | |
|---|---|---|---|
| CA | 2547747 | A1 * | 10/2007 |
| JP | 2004027663 | | 1/2004 |
| JP | 2005240557 | | 9/2005 |

OTHER PUBLICATIONS

International Preliminary Report on Patentability for PCT/US2011/058484 dated May 10, 2013.

(Continued)

*Primary Examiner* — Jamie L McGowan
(74) *Attorney, Agent, or Firm* — Rathe Lindenbaum LLP

(57) ABSTRACT

A snow thrower impeller includes a layer of material comprising blade support walls and blades extending from the blade support walls.

43 Claims, 19 Drawing Sheets

(56) References Cited

U.S. PATENT DOCUMENTS

| | | | | | |
|---|---|---|---|---|---|
| 3,721,025 | A | * | 3/1973 | Orr | 37/227 |
| 3,736,674 | A | * | 6/1973 | Enters | 37/248 |
| 3,805,421 | A | * | 4/1974 | Kamlukin et al. | 37/233 |
| 3,913,247 | A | * | 10/1975 | Ruhl | 37/258 |
| 3,951,611 | A | * | 4/1976 | Morrill | 428/587 |
| 4,549,365 | A | * | 10/1985 | Johnson | 37/251 |
| 4,646,850 | A | | 3/1987 | Brown et al. | |
| 4,671,739 | A | * | 6/1987 | Read et al. | 416/230 |
| 4,783,915 | A | * | 11/1988 | Sasaki et al. | 37/251 |
| 5,127,174 | A | | 7/1992 | Takeshita | |
| 6,101,794 | A | * | 8/2000 | Christopherson et al. | 56/6 |
| 6,293,349 | B1 | * | 9/2001 | Marshall et al. | 172/15 |
| 6,470,662 | B1 | * | 10/2002 | Burke et al. | 56/255 |
| 6,722,114 | B1 | * | 4/2004 | Poole et al. | 56/295 |
| 6,881,035 | B1 | * | 4/2005 | Paulsen | 416/183 |
| 6,938,364 | B2 | * | 9/2005 | White et al. | 37/248 |
| 7,121,021 | B2 | * | 10/2006 | Sakai | 37/251 |
| 7,305,777 | B2 | * | 12/2007 | Kettering et al. | 37/233 |
| 7,473,025 | B1 | | 1/2009 | Howk | |
| 2002/0178622 | A1 | | 12/2002 | Loegering et al. | |
| 2004/0255492 | A1 | | 12/2004 | White, III et al. | |
| 2005/0241190 | A1 | * | 11/2005 | Kettering et al. | 37/258 |
| 2008/0075598 | A1 | | 3/2008 | Chen et al. | |
| 2008/0226456 | A1 | | 9/2008 | Pennington et al. | |
| 2009/0205226 | A1 | * | 8/2009 | Olmr et al. | 37/257 |
| 2010/0319223 | A1 | * | 12/2010 | Wians et al. | 37/244 |

OTHER PUBLICATIONS

"TORO 828LE Power Max Snowthrower", The Toro Company 2003. Photograph of Toro Impeller part 106-4576-03 in "TORO 828LE Power Max Snowthrower", The Toro Company 2003.

* cited by examiner

SNOW THROWER IMPELLER

CROSS-REFERENCE TO RELATED PATENT APPLICATIONS

The present application claims priority under 35 USC section 120 and is a continuation-in-part of co-pending U.S. patent application Ser. No. 12/916,399 filed on Oct. 29, 2010 by Daniel L. Steinike, James W. Mast and Samuel J. Gerrits, and entitled SNOW THROWER IMPELLER, the full disclosure of which is hereby incorporated by reference.

BACKGROUND

Snow throwers, also known as snow blowers, utilize an impeller to throw snow. Existing snow thrower impellers may not efficiently throw the snow and may be expensive and difficult to manufacture.

DETAILED DESCRIPTION OF THE EXAMPLE EMBODIMENTS

Figure 1:
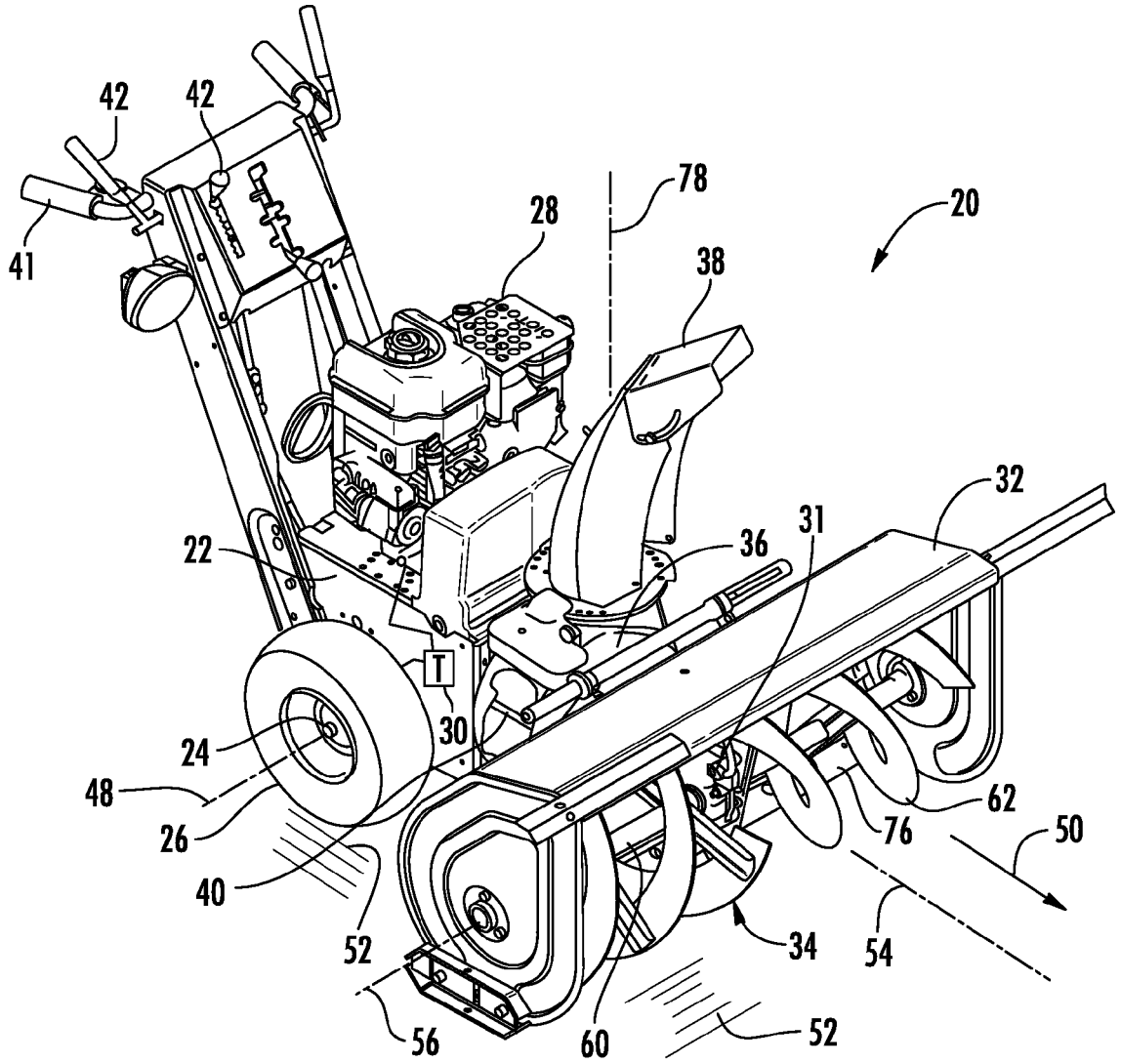
FIG. 1 is a perspective view of a snow thrower including an impeller assembly according to an example embodiment.

FIG. 1 is a front perspective view of a snow thrower 20 according to an example embodiment. As will be described hereafter, snow thrower includes an impeller assembly 40 having a simple and inexpensive impeller that efficiently throws snow. In addition to impeller assembly 40, snow thrower 20 includes frame 22, axle 24, wheels 26, engine 28, drive transmission 30 (schematically shown), discharge transmission 31, auger housing 32, auger 34, impeller housing 36 and discharge chute 38.

Frame 22 comprises one or more structures supporting the remaining components of snow thrower 20. In the example illustrated in which snow thrower 20 is a walk-behind snow thrower, frame 22 supports axle 24, wheels 26, engine 28, drive transmission 30, auger housing 32, auger 34, impeller housing 36, discharge chute 38 and impeller assembly 40. Frame 22 further supports handles or grips 41 and controls 42. In other embodiments where snow thrower 20 comprises a riding snow thrower, frame 22 may additionally support a seat and may be supported by a greater number of wheels, tracks or other ground propulsion members. In embodiments where snow thrower 20 is mounted to another vehicle, such as a lawnmower, an all terrain vehicle, truck or the like, frame 22 may or may not support axle 24 and wheels 26 and may be configured to be removably mounted to the vehicle. In embodiments where snow thrower 20 is powered by the engine or other torque source of the vehicle to which snow thrower 20 is mounted, frame 22 may not support an engine, such as engine 28, and may alternatively merely comprise a mounting structure or bracket supporting auger housing 32, auger 34, impeller housing 36, discharge chute 38 and impeller assembly 40 and facilitating their connection to the vehicle. Frame 22 may have a variety of different sizes and shapes, depending upon the machine or the method by which snow thrower 20 is moved across the terrain.

Figure 2:
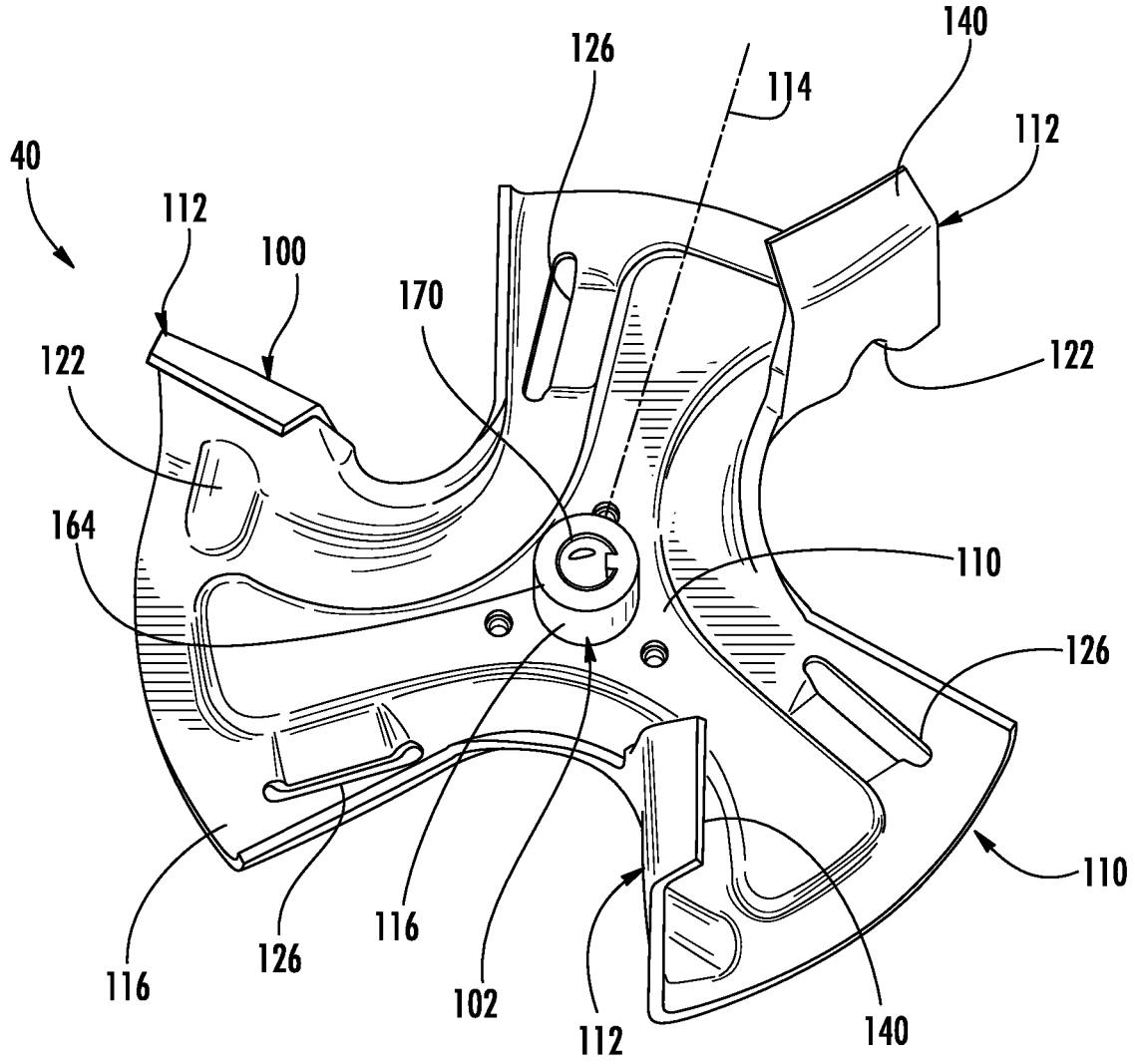
FIG. 2 is a top perspective view of the impeller assembly of FIG. 1.

Axle 24 is supported by frame 22 and rotationally supports wheels 26 (both of which are shown in FIG. 2). In the example illustrated, axle 24 is configured to be rotationally driven by engine 28 using torque transmitted by transmission 30. Axle 24 extends along an axis 48 that is substantially perpendicular to the direction of travel 50 of snow thrower 20.

Wheels 26 are joined to axle 24 so as to elevate and support frame 22 above the terrain 52. Wheels 26 further facilitate movement of snow thrower 20 across terrain 52. In the example illustrated, wheels 26 are rotationally driven to propel snow thrower 20. In other embodiments, wheels 26 may be physically pushed by a person or other vehicle. In some embodiments, wheels 26 may be replaced with one of more tracks or other ground engaging members. In embodiments where snow thrower 20 is supported along the terrain by another vehicle, axle 24 as well as wheels 26 may be omitted.

Engine 28 comprises an internal combustion engine supported by frame 22 and operably coupled to wheels 26 by drive transmission 30 so as to drive wheels 26. Engine 28 is further operably coupled to auger 34 and impeller assembly 40 by discharge transmission 31 so as to rotationally drive auger 34 about axis 56 and so as to rotationally drive impeller assembly 40 about axis 54. In other embodiments, engine 28 may alternatively only drive auger 34 and impeller assembly 40. In other embodiments, other mechanisms may be used to drive auger 34, impeller assembly 40 or drive wheels 26.

Transmission 30 (schematically shown) comprises a series or arrangement of structures configured to transmit torque from engine 28 to axle 24 or wheels 26. Likewise, discharge transmission 31 comprises a series or arrangement of structures configured to transmit torque from engine 28 to auger 34 and impeller assembly 40. Examples of such structures include, but are not limited to, drive shafts and driven shafts, chain and sprocket arrangements, belt and pulley arrangements, gear trains and combinations thereof. In one embodiment, transmission 31 is disposed on both sides of impeller 34, wherein transmission 36 extends between engine 28 and impeller assembly 40 and wherein transmission 36 further extends between impeller assembly 40 and auger 34. For example, in one embodiment, transmission 36 may include a bevel gear between impeller assembly 40 and auger 34 for converting torque about axis 54 from impeller assembly 40 to torque about axis 56 for auger 34.

Auger housing 32 forms the head of snow thrower 20 and partially extends about or partially surrounds auger 34. Auger housing 32 rotationally supports auger 34 for rotation about axis 56 which is perpendicular to axis 54 and the direction of forward travel 50. Auger housing 32 contacts and scrapes against terrain 52 so as to scrape and lift snow from terrain 52 and towards impeller assembly 40.

Auger 34 comprises a mechanism configured to slice or cut through snow and to direct or move such snow towards impeller assembly 40. Auger 34 includes a central shaft 60 supporting a helical ribbon or blade 62. Shaft 60 is rotationally supported about axis 54. Blade 62 cuts through the snow and directs snow towards axis 54 and towards an inlet opening to impeller 34. In other embodiments, auger 32 may have other configurations. For example, in lieu comprising ribbons, blade 62 may comprise full blades continuously extending from shaft 60.

Impeller housing 36 extends about impeller assembly 40 and opens into an interior of auger housing 32. Impeller housing 36 further opens into chute 38. Impeller housing 38 cooperates with impeller assembly 40 such that snow impelled or moved by impeller assembly 40 is directed up and through chute 38.

Chute 38 comprises one or more structures configured to receive snow impelled by impeller 34 and to direct such snow away from snow thrower 20. In the example illustrated, chute 38 is configured to be selectively rotated about a substantially vertical axis 78 such that snow may be blown or thrown to either transverse side of snow thrower 20 and at various rear and forward angles with respect to snow thrower 20. In one embodiment, chute 38 is configured to be manually rotated about axis 78. In other embodiments, such rotation may be powered. In yet other embodiments, chute 38 may be stationary.

Figure 3:
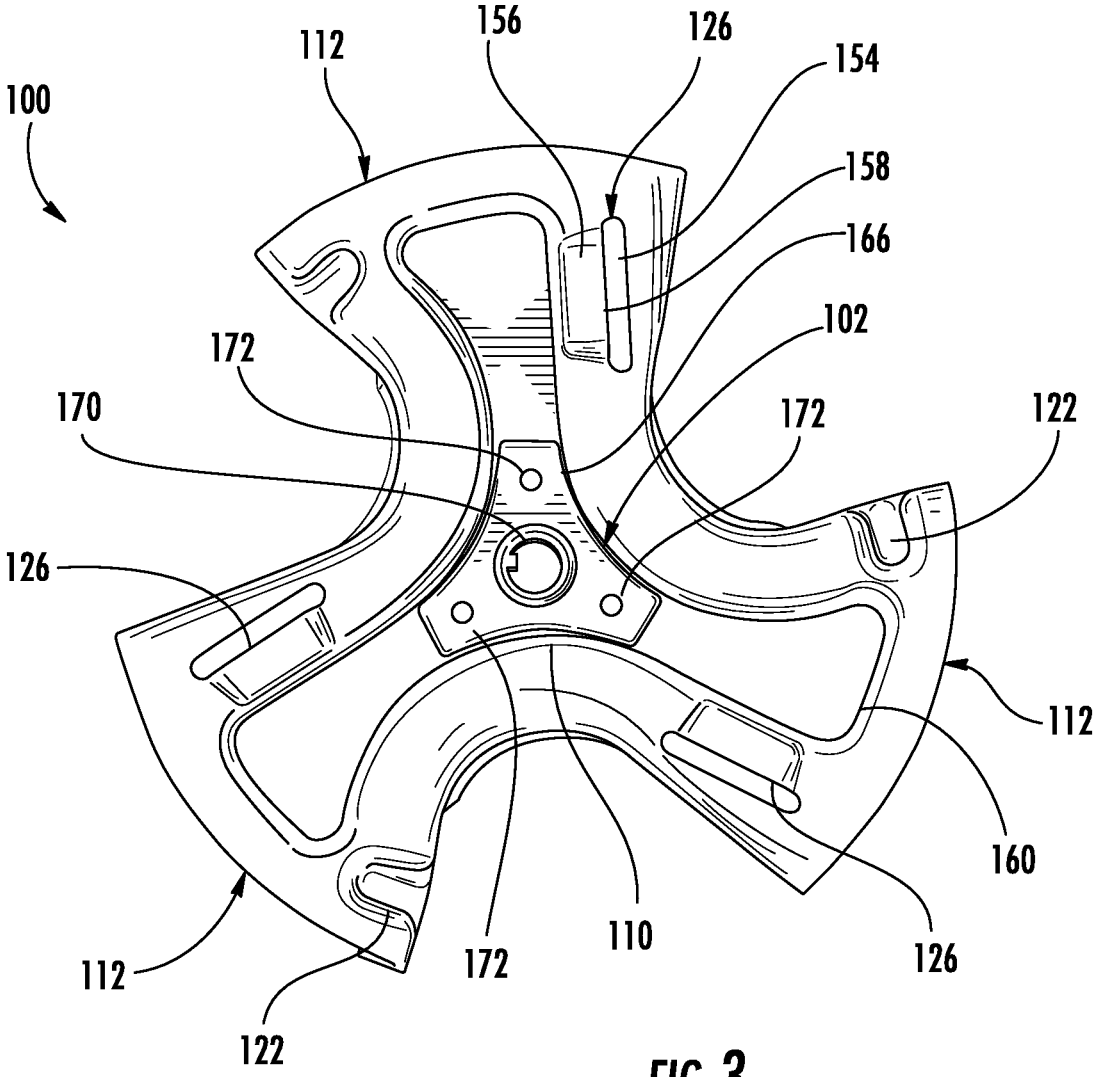
FIG. 3 is a rear perspective view of the impeller assembly of FIG. 2.

Impeller assembly 40 is configured to receive the snow gathered and directed to it by auger 34 and to further impel snow away from snow thrower 20 through chute 38. FIGS. 2 and 3 illustrate impeller assembly 40 in more detail. Impeller assembly 40 includes impeller 100 and shaft coupler 102.

Figure 4:
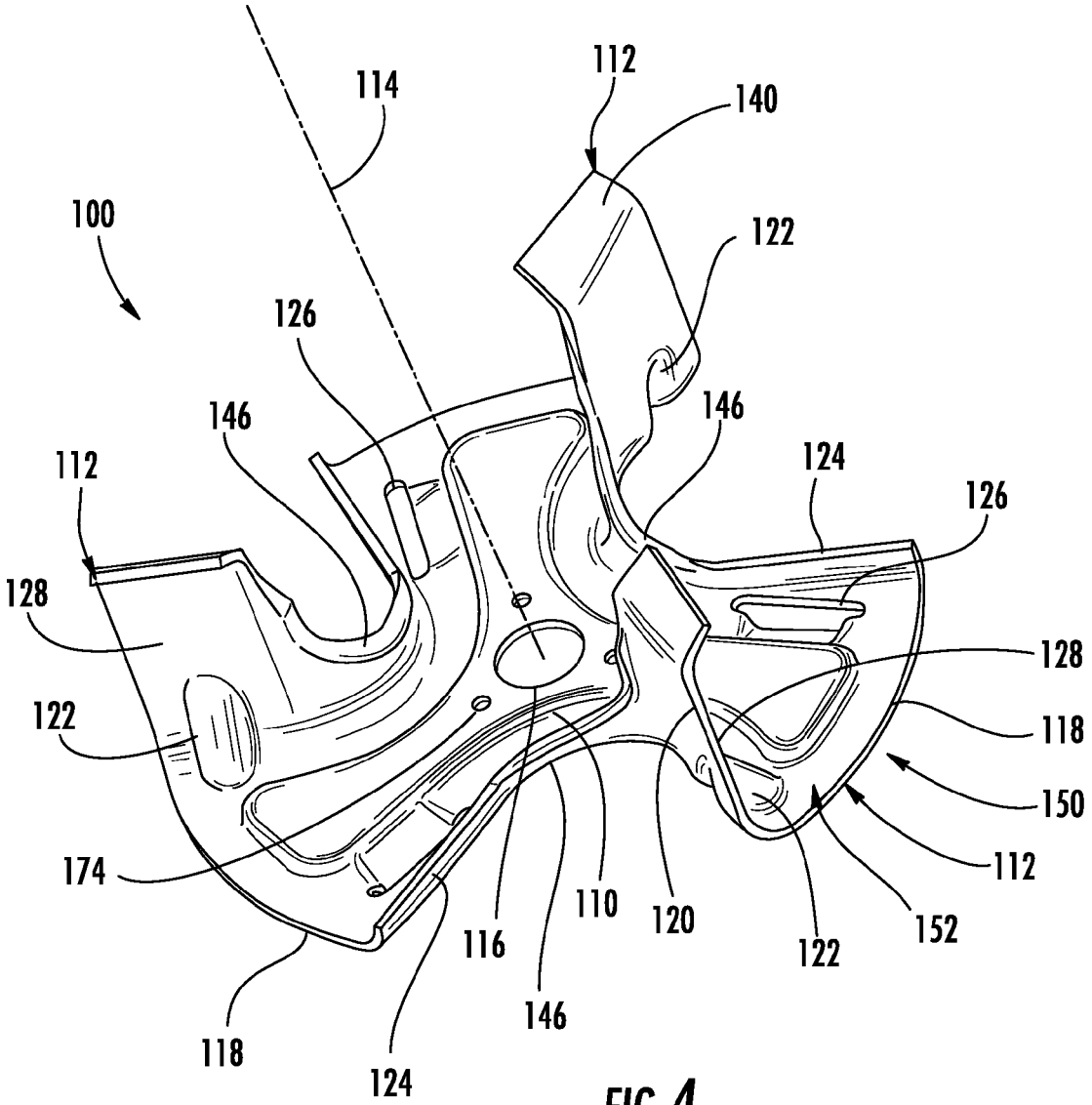
FIG. 4 is a top perspective view of an impeller of the impeller assembly of FIG. 2.

Impeller 100 is shown removed from shaft coupler 102 in FIGS. 4-9. As shown by FIG. 4, impeller 100 comprises a single layer of material shaped to form and provide a central portion 110 and a plurality of scoops or shovels 112 angularly spaced about central portion 110. In one embodiment, impeller 100 is formed from stamping a sheet of material, such as low carbon steel, wherein the three-dimensional structures of impeller 100 are formed by bending or deforming portions of the sheet. Because impeller 100 is formed by stamping a sheet of material and because its three-dimensional structures are formed by solely by deforming or bending portions of the sheet, the manufacture of impeller 100 may be done without welding or with minimal welding or molding and with a minimal number of fasteners, reducing manufacturing time, cost and complexity. In other embodiments, impeller 100 may be formed by other manufacturing processes. In one embodiment, the sheet of material may comprise a single homogenous layer of material. In other embodiments, the sheet of material may include multiple laminations of material to form a sheet which is subsequently shaped, such as being stamped and deformed.

Central portion 110 comprises that portion of impeller 100 that joins or interconnects each of shovels 112. Central portion 110 further facilitates connection of impeller 100 to shaft coupler 102 (shown in FIGS. 2 and 3). Central portion 110 extends generally perpendicular to a rotational axis 114 of impeller 100. Central portion 110 includes an aperture 116 configured to receive shaft coupler 102.

Shovels 112 comprise structures configured to scoop and throw snow through discharge chute 38. Each shovel 112 includes a back or blade supporting wall 118, blade 120, depression gusset 122, web 124 and louver 126. Blade support wall 118 serves as a back, bottom or floor of each shovel 112. Blade support wall 118 comprises a generally planar portion of impeller 100 extending from central portion 110 substantially perpendicular to the rotational axis 114 of impeller 100.

Blade 120 of each shovel 112 extends from an associated blade supporting wall 118. In the example, each blade 120 comprises an upstanding wall extending in a largely radial direction with respect to rotational axis 114. Each blade 120 extends from a trailing radial edge of each blade supporting wall 118. Each blade 120 has a snow driving face 128 facing in a direction in which impeller 100 is rotated by engine 28 (shown in FIG. 1). For purposes of this disclosure, the term "snow driving face" means those surfaces that contact and force or throw snow through a discharge chute when the impeller is being driven.

Figure 5:
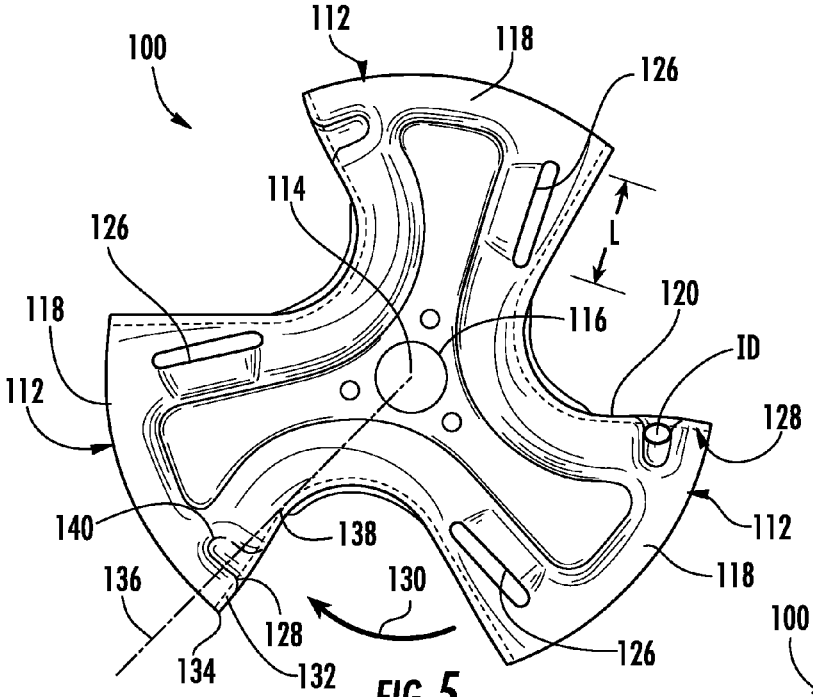
FIG. 5 is a bottom plan view of the impeller of FIG. 4.

FIG. 5 is a top view of impeller 100 illustrating the snow driving face 128 of each blade 120. As indicated by arrow 130 in FIG. 5, impeller 100 is configured to be driven in a clockwise direction (a "forward direction") about axis 114 by engine 28 (shown in FIG. 1). Each snow driving face 128 extends behind its associated or corresponding blade supporting wall 118. Said another way, the blade support wall 118 of each shovel 112 extends along the base of snow driving face 128 and projects forward in the rotational direction of impeller 100. As a result, blade support wall 118 assists in carrying and supporting snow being driven by snow driving face 128 prior to throwing of the snow through discharge chute 38 (shown a FIG. 1).

As further shown by FIG. 5, the snow driving face 128 of each blade 120 includes a recessed portion 132 proximate an outermost radial tip 134 that faces and is recessed from a plane 136 containing rotational axis 114 and extending from rotational axis 114 tangent to the snow driving face 128 of the blade 120. For purposes of this disclosure, the term "tangent" means to touch a curve or surface at a point so that it is closer to the curve in the vicinity of the point than any other line or plane drawn through the point. Because snow driving face 128 includes recessed portion 132, snow driving face 128 more effectively throws snow through discharge chute 38.

In the example embodiment illustrated, recessed portion 132 of snow driving face 128 is concave. In one embodiment, recessed portion 132 has a radius of curvature of between 16 inches and 22 inches. In the example illustrated, snow driving face 128 additionally includes a convex portion 138 facing the plane between recessed portion 132 and the rotational axis 114 of impeller 100. The convex portion 138 further enhances the snow throwing efficiency of snow driving face 128 of blade 120.

In other embodiments, snow driving face 128 may have other configurations. For example, in other embodiments, recessed portion 132 of snow driving face 128 may not be concave, but may instead be planar or flat or may be convex.

In some embodiments, convex portion 138 may be omitted. In yet other embodiments, recessed portion 132 may be omitted, wherein snow driving face 128 extends within plane 136 or forward of plane 136.

Figure 6:
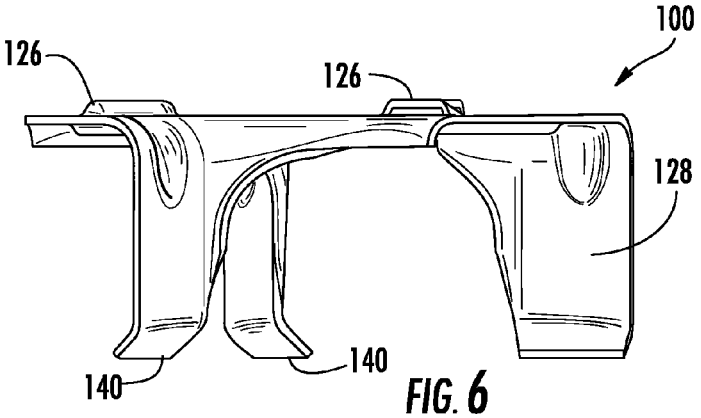
FIG. 6 is a first side elevational view of the impeller of FIG. 4.
Figure 7:
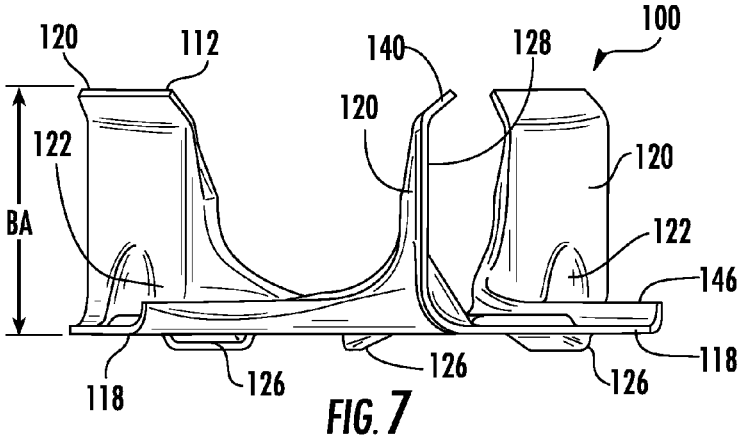
FIG. 7 is a second side elevational view of the impeller of FIG. 4.

As shown by FIGS. 6 and 7, each blade 120 additionally includes an angled top or tip portion 140. Each tip portion 140 extends oblique from snow driving face 128 in the forward direction from snow driving face 128. Tip portion 140 cooperate with snow driving face 128 of blade 120 and blade supporting wall 118 to contact snow on three sides to facilitate scooping and caring of snow to discharge chute 38 (shown in FIG. 1). In other embodiments, tip portion 140 may be omitted.

Figure 8:
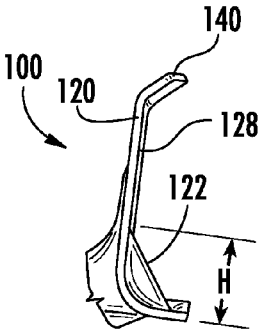
FIG. 8 is a sectional view of the impeller of FIG. 4.

As shown by FIGS. 6 and 8, depression gussets 122 comprise indentations formed in the layer, wherein the indentations are angled so as to extend between and unite blade supporting wall 118 and blade 120. Depression gussets 122 serve as trusses for reinforcing and rigidifying blade 120. Because depression gussets 12 are formed by deforming the layer of material, rather than welding or otherwise connecting additional structures, manufacturing cost and complexity of impeller 100 may be reduced.

As shown by FIG. 8, each gusset 138 has a height, H, measured perpendicular from blade supporting wall 118, of between 1.5 inches and 1.9 inches. As shown in FIG. 5, each gusset 138 has an inside diameter ID of between 0.4 inches and 0.8 inches. As a result, the depression gussets 122 provide blade 120, formed from low carbon nine gauge steel, with sufficient strength to engage, contact and throw snow. In other embodiments, depression gussets 122 may have other configurations or may be omitted.

As best shown by FIG. 4, web 124 comprises an edge portion extending along a leading edge of each blade supporting wall 118 and to the next successive blade 120 of the next successive shovel 112. Web 124 has a concave side 146 facing away from rotational axis 114 of impeller 100. Web 124 rigidifies and strengthens blade supporting wall 118 as well as the next successive blade 120 of the next successive shovel 112. In other embodiments, web 124 may be omitted or may have other configurations.

Figure 9:
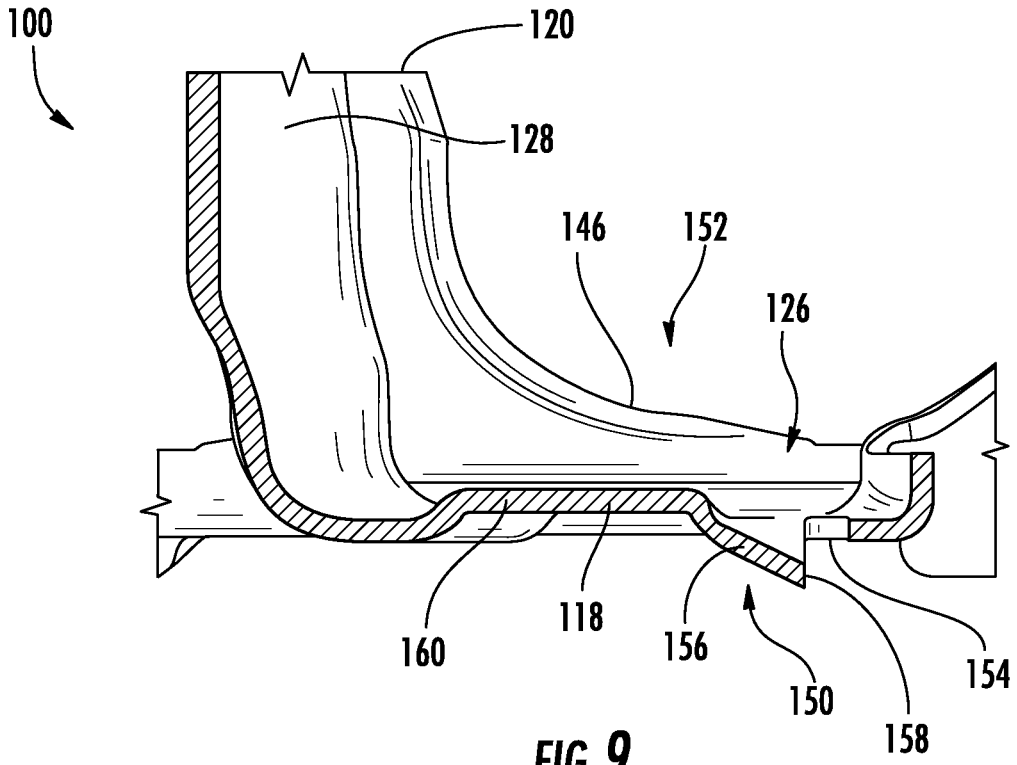
FIG. 9 is a sectional view of the impeller of FIG. 4.

Louvers 126 are formed in blade supporting walls 118 of shovels 112. Louvers 126 assist in removing snow and ice from a backside 150 of blade supporting walls 118 and directing such removed the snow and ice to an opposite front side 152 of blade supporting walls 118. FIG. 9 is a sectional view of impeller 100 illustrating one of louvers 126 in more detail. As shown by FIG. 9, each louver 126 comprises an opening 154 through blade supporting wall 118 between sides 150 and 152. Each opening 154 is partially framed by a slanted fin or slat 156 having a scraping edge 158 projecting away from impeller 100 on side 150. As shown by FIG. 4, scraping edge 158 of each louver 126 faces in the forward direction, i.e., the direction in which impeller 100 is rotated by engine 28 about axis 114.

During rotation of impeller 100, snow and ice may sometimes collect under or behind blade supporting portion 118 between blade supporting portion 118 and an axial end of impeller housing 36. The snow and ice buildup may damage impeller 100 or impeller housing 136. The rotational impeller 100, edge 158 scrapes or removes such built-up snow and ice, whereby the snow and ice passes through opening 154 to the front side 152 of impeller 100. Continued rotation of impeller 100 causes snow driving face 128 of blade 120 to contact and throw the snow through discharge chute 38 (shown in FIG. 1). As a result, the likelihood of snow and ice buildup and the likelihood of damage resulting from such build-up is reduced. Because louvers 126 are formed by stamping and deforming portions of a single layer of material forming impeller 100, no additional steps or additional parts are utilized in providing louvers 126.

According to one example embodiment, each scraping edge 158 has a length L (shown in FIG. 5) of at least 1 inch and nominally between 1.1 inches and 1.5 inches. As a result, each scraping edge 158 sufficiently removes accumulated snow and ice. In other embodiments, louvers 126 may have other configurations or may be omitted. In the example embodiment illustrated, impeller 100 is specifically configured to be stamped and formed from a single sheet of material. As shown by FIG. 7, impeller 100 includes three shovels spaced approximately 120 degrees apart from one another with no intervening shovels 112 therebetween and with no intervening blades therebetween. Because impeller 100 includes only three shovels 112 and only three blades 120, each shovel 112 may be formed solely from a single stamped and deformed sheet (without any additional parts or components) and may be provided with a blade height, BH, measured perpendicularly from blade supporting wall 118, of at least 4 inches and nominally between 4.45 inches and 5.5 inches. In other words, because impeller 120 consists of central portion 110 and three shovels 112, each shovel 112 may be formed from a stamped sheet and may have a larger scooping volume, defined by the surface areas of blade supporting wall 118 and blade 120, allowing shovels 112 to more efficiently discharge snow.

In the example illustrated, impeller 100 is specifically configured for self alignment with shaft coupler 102. As shown by FIG. 3, impeller 100 includes a non-circular depression 160 about aperture 116 (shown in FIG. 4). Depression 160 extends into central portion 110. In the example illustrated, depression 160 further radially extends outward from central portion 110 along each of blade supporting walls 118 of shovels 112. As a result, depression 160 serves dual functions of self aligning with shaft coupler 102 and strengthening blade supporting walls 118 of shovels 112. In the example illustrated, depression 160 includes three legs angularly spaced 120 degrees apart from one another and centrally extending along each shovel 112. In other embodiments, depression 160 may have other configurations or may be omitted.

Shaft coupler 102 comprises a mechanism configured to connect impeller 100 to a shaft of transmission 31. In the example illustrated, shaft coupler 102 is configured to be connected to impeller 100 without welding, facilitating easier manufacture of impeller assembly 40. Shaft coupler 102 includes hub 164 and key portions 166. Hub 164 is configured to be inserted through aperture 161 and includes a central bore 170 configured to receive the shaft (not shown) of transmission 31. In one embodiment, the shaft may be secured to hub 164 with a set screw 171 (shown in FIG. 3). In other embodiments, the shaft may be secured to hub 164 in other fashions.

Key portions 166 comprise extensions extending from hub 164 which are sized and located so as to be mated or keyed into the noncircular depression 160. In the example illustrated, depression 160 includes three fingers or extensions equiangularly spaced about axis 114 (spaced 120 degrees in the embodiment shown), whereas coupler 102 includes a corresponding three projections or fingers which are received within depression 160. As a result, coupler 102 provides an integral key such that impeller 100 is rotated with the rotation of the shaft connected to hub 164. In other embodiments, shaft coupler 102 may have other configurations or may be omitted where other mechanisms are used for joining transmission 31 to impeller 100.

As shown by FIG. 3, each of key portions 166 additionally includes a bore 172 through which a fastener may extend into central portion 110 to further secure shaft coupler 102 to impeller 100. In one embodiment, central portion 110 includes corresponding bores 174 (shown in FIG. 4) through which fasteners may extend. In one embodiment, one or both of bores 172, 174 may be internally threaded. In other embodiments, such fasters may comprise bolts and corresponding nuts. In still other embodiments, other mechanisms may be used to retain coupler 102 to impeller 100.

Figure 10:
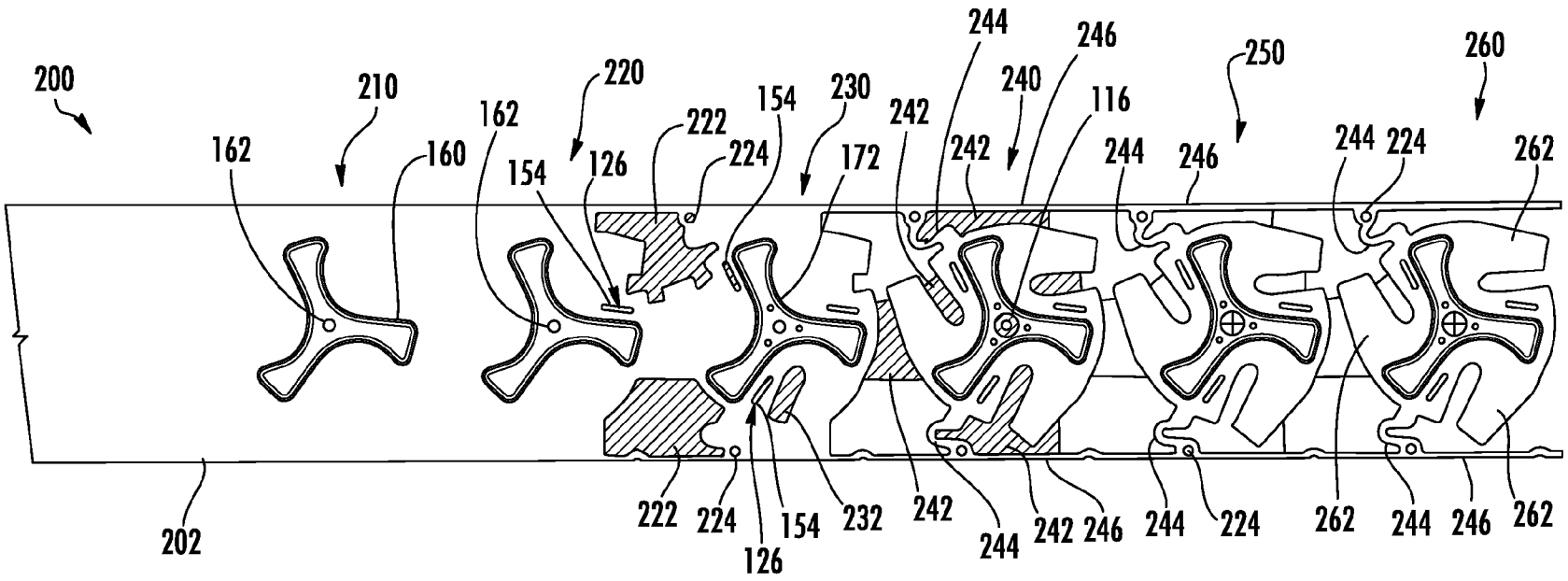
FIG. 10 is a top plan view of a strip layout for forming the impeller of FIG. 4.

FIG. 10 is a strip layout 200 illustrating one example method for forming impeller 100 as shown in FIG. 4. From left to right, strip layout 200 illustrates various stamping, embossing and forming steps or stages for transforming a layer or sheet of material into a three-dimensional impeller such as impeller 100. As noted above, in one embodiment, impeller 100 is formed from a coil, sheet or strip 202 of 9 gauge low carbon steel. In other embodiments, other materials or thicknesses may be employed for forming impeller 100.

In the example illustrated, in a first step or stage 210, an embossing device or tool deforms strip 202 to form depression 160. A stamping tool also works upon strip 202 to form an initial pilot hole 162 that is used for alignment of subsequent tooling with strip 202.

In stage 220, a stamping tool or die engages strip 202 to form the opening 154 and slat 156 (shown in FIG. 9) of a louver 126. In addition, tooling further engages strip 202 to cut out portions 222 and pilot holes 224. In step or stage 230, the tooling forms openings 154 and slats 156 of the other louvers 126 and further forms bores 172. The tooling also cuts out or removes portion 232.

In stage 240, tooling works upon strip 202 to cut out or form aperture 116. The tooling further removes portions 242 to form expansion webs 244 extending from carrier 246. In stage or step 250, tooling works upon strip 202 to provide each blade 120 (shown in FIG. 4) with its cup shape and to further bend tip portions 140. Lastly, in step 260, the tooling works upon strip 202 to deform and bend portions 262 to form blades 120, providing blades 120 with their generally perpendicular orientation with respect to supporting wall 118 as shown in FIG. 4. After impeller 100 is substantially completed, the individual impeller part is separated from carrier 246 by severing the impeller part from expansion web 244. As shown in FIG. 10, impeller 100 is formed without welding or other complex or time-consuming fabrication processes.

Figure 11:
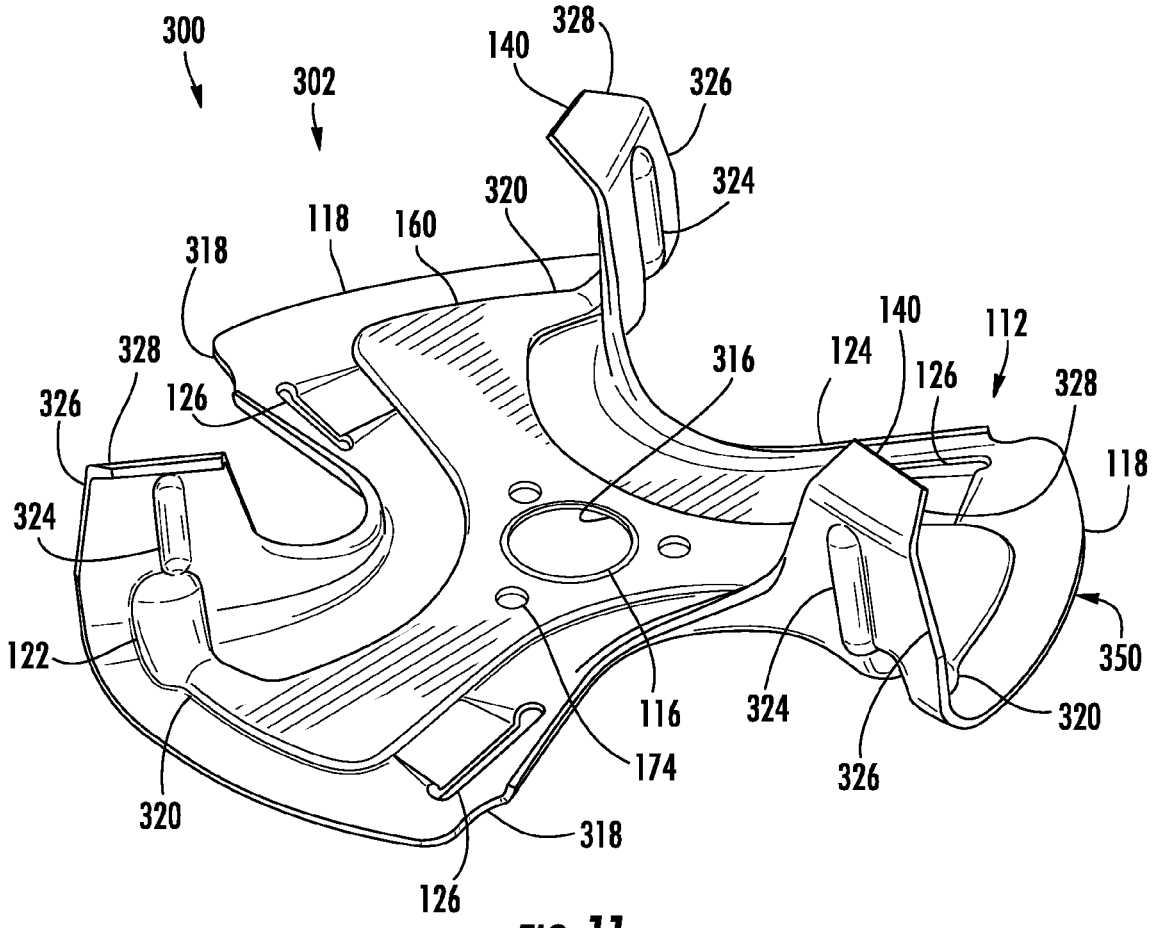
FIG. 11 is a front perspective view of another example implementation of the impeller of FIG. 4.
Figure 12:
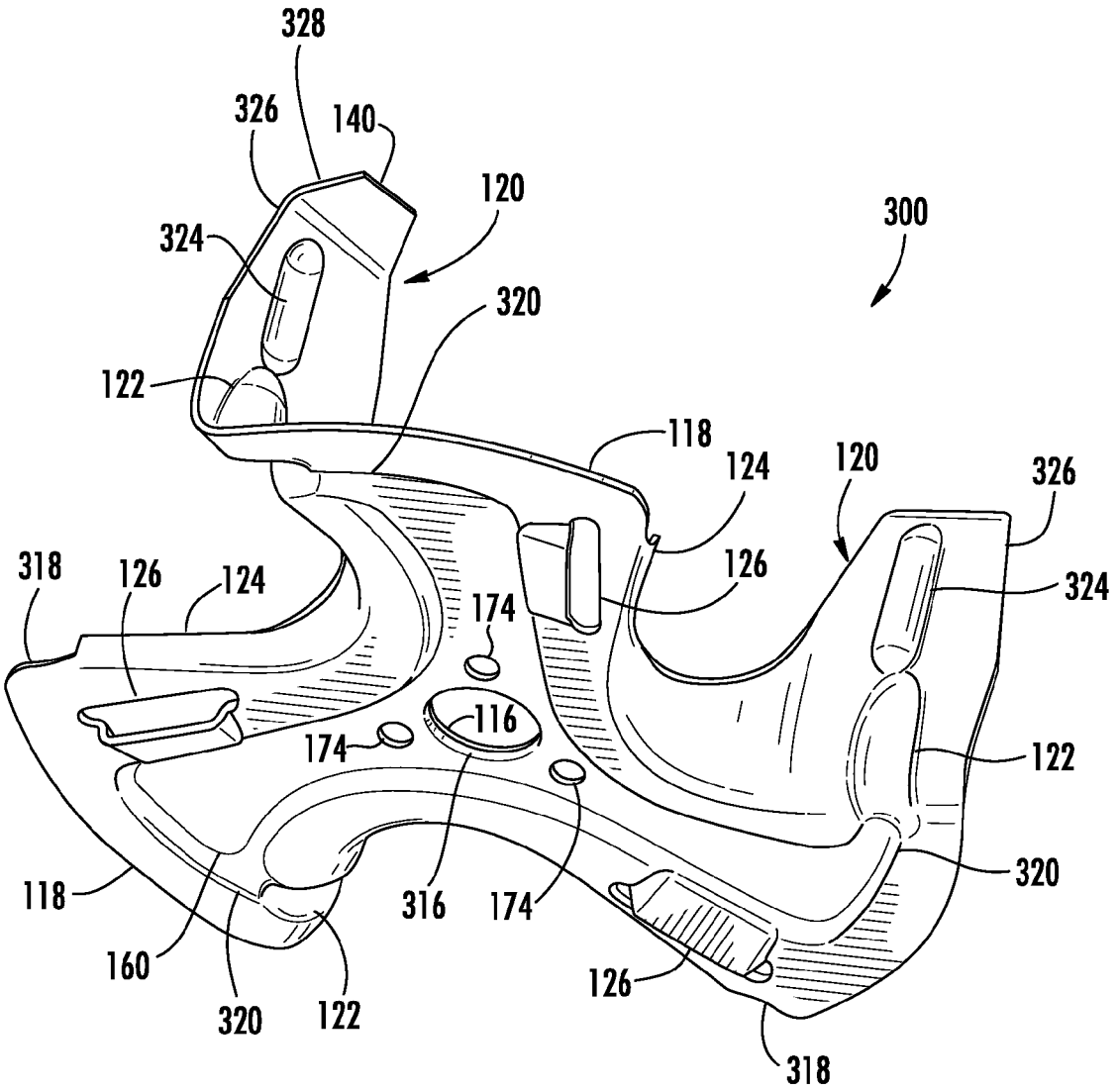
FIG. 12 is a rear perspective view of the impeller of FIG. 11.

FIGS. 11 and 12 illustrate impeller 300, another example implementation of impeller 100. FIG. 11 is a perspective view illustrating a front side 302 of impeller 300 FIG. 12 is a perspective view illustrating a rear side 304 of impeller 300. Impeller 300 is similar to impeller 100 except that impeller 300 comprises back face depression 316, notches 318, intermediate depression channel 320, ribs 324, tapers 326 and chamfers 328. Back face depression 316 comprises an offset formed about aperture 116. Back face depression 216 comprises a sunken portion in the rear side 304 of impeller 300 about aperture 116. Back face depression 316 facilitates a more secure connection between impeller 300 and shaft coupler 102 (shown in FIG. 13).

Figure 13:
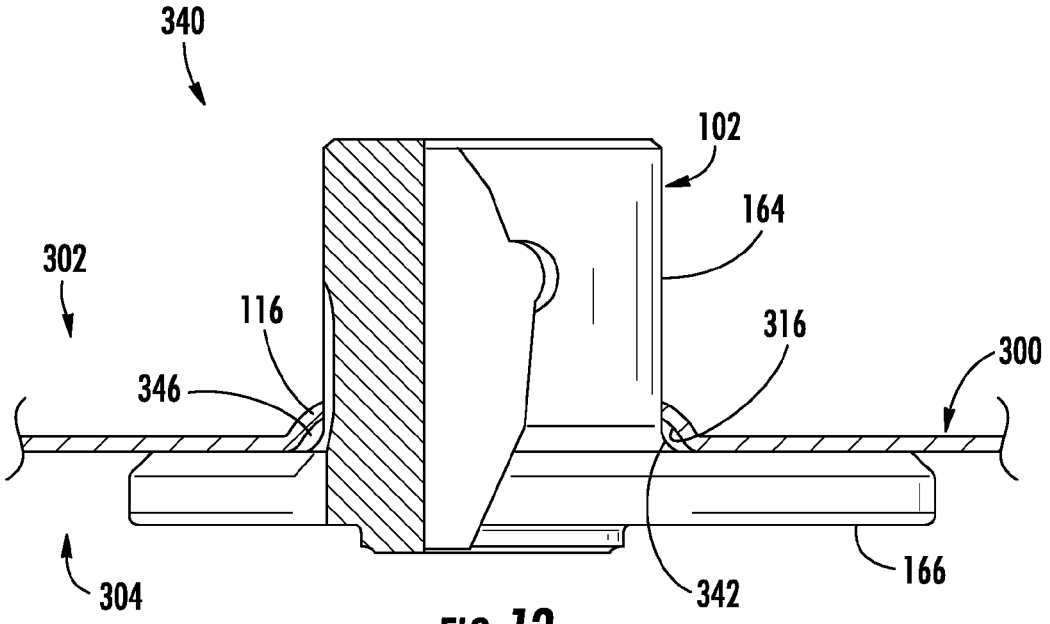
FIG. 13 is a sectional view of an example impeller assembly including the impeller of FIG. 11.

FIG. 13 illustrates impeller assembly 340 which includes impeller 300 mounted to shaft coupler 102 described above with respect FIGS. 2 and 3. As further shown by FIG. 13, shaft coupler 102 comprises a corner joint 320 between hub 164 and key portions 166. In the example illustrated, corner joint 320 is a result of a sintering process increases shear strength between hub 164 and key portions 166.

As shown by FIG. 13, back face depression 316 provides an annular space or void 342 about aperture 116 in rear side 304 which is sized to accommodate and receive corner joint 342. Because back face depression 316 accommodates corner joint 342, the rear side 304 of impeller 300 lies more flush or flat against key portions 166 while aperture 116 continues to retain impeller 300 about hub 164. In other words, a face of each key portion 166 lies flush against a floor of depression 160. As a result, back face depression 316 reduces or eliminates the formation of a soft joint between impeller 300 and coupler 102. Such soft joints constitute spacing between impeller 300 and key portions 166 after fasteners joining such components have been tightened to a predetermined torque. During dynamic loading, such as during rotation of impeller 300, dynamic the formation of impeller 300 may cause such gaps to shrink, further causing the once tight fastener connections to become loose, increasing shear loading upon such fasteners. By accommodating corner joint 342, back face depression 316 reduces or eliminates such gaps between rear side 304 of impeller 300 and key portions 166 to reduce or eliminate such soft joints. In the implementation illustrated, back face depression 316 is formed by embossing, bending or otherwise deforming those portions of impeller 300 about aperture 116. In other implementations, back face depression 316 may be formed by chamfering, molding, casting or material removal to form the void 346 about aperture 116. In some implementations, back face depression three and 16 may be omitted.

Figure 14:
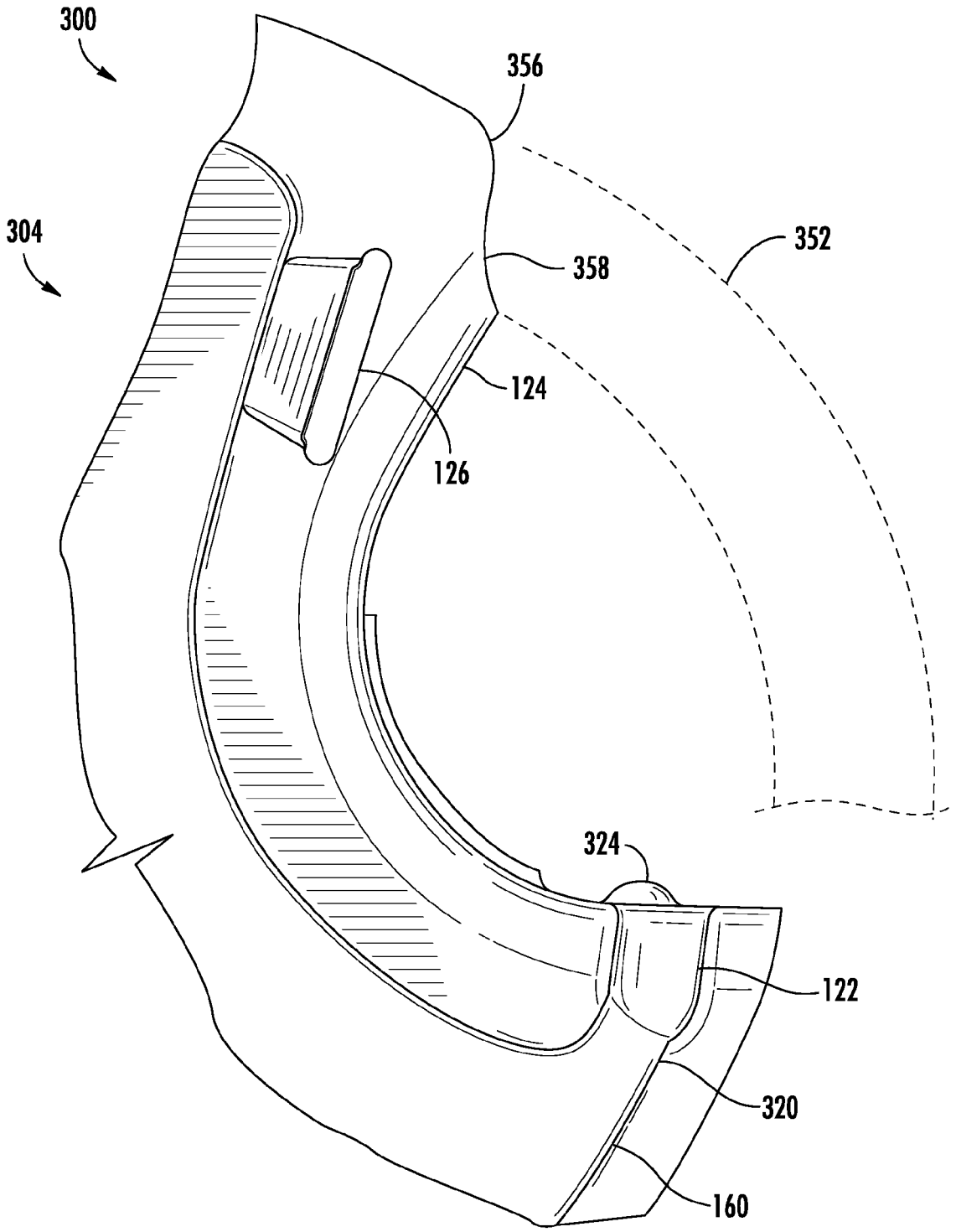
FIG. 14 is an enlarged fragmentary rear plan view of the impeller of FIG. 11.

Notches 318 comprise cut outs or openings formed in web 124 on an outer end of Web 124 between outer radial ends 350 of blade supporting walls 118 and louvers 126. As shown by FIG. 14, notches 318 terminate the length of web 124 along each shovel 112 such that snow or ice buildup in a circumferential band 352 from louver 126 to outer radial ends 118 between a back of impeller housing 36 (shown in FIG. 1) and blade supporting wall 118 is reduced.

In the implementation illustrated, each of notches 318 circumferentially overlaps at least a portion of the associated louver 126. In the example implementation illustrated, notches 318 has a first portion room 356 with the radius of approximately 0.461 inches and a second portion 358 with a radius of approximately 1.023 inches. In other implementations, each of notches 358. In other dimensions or configurations.

Figure 15:
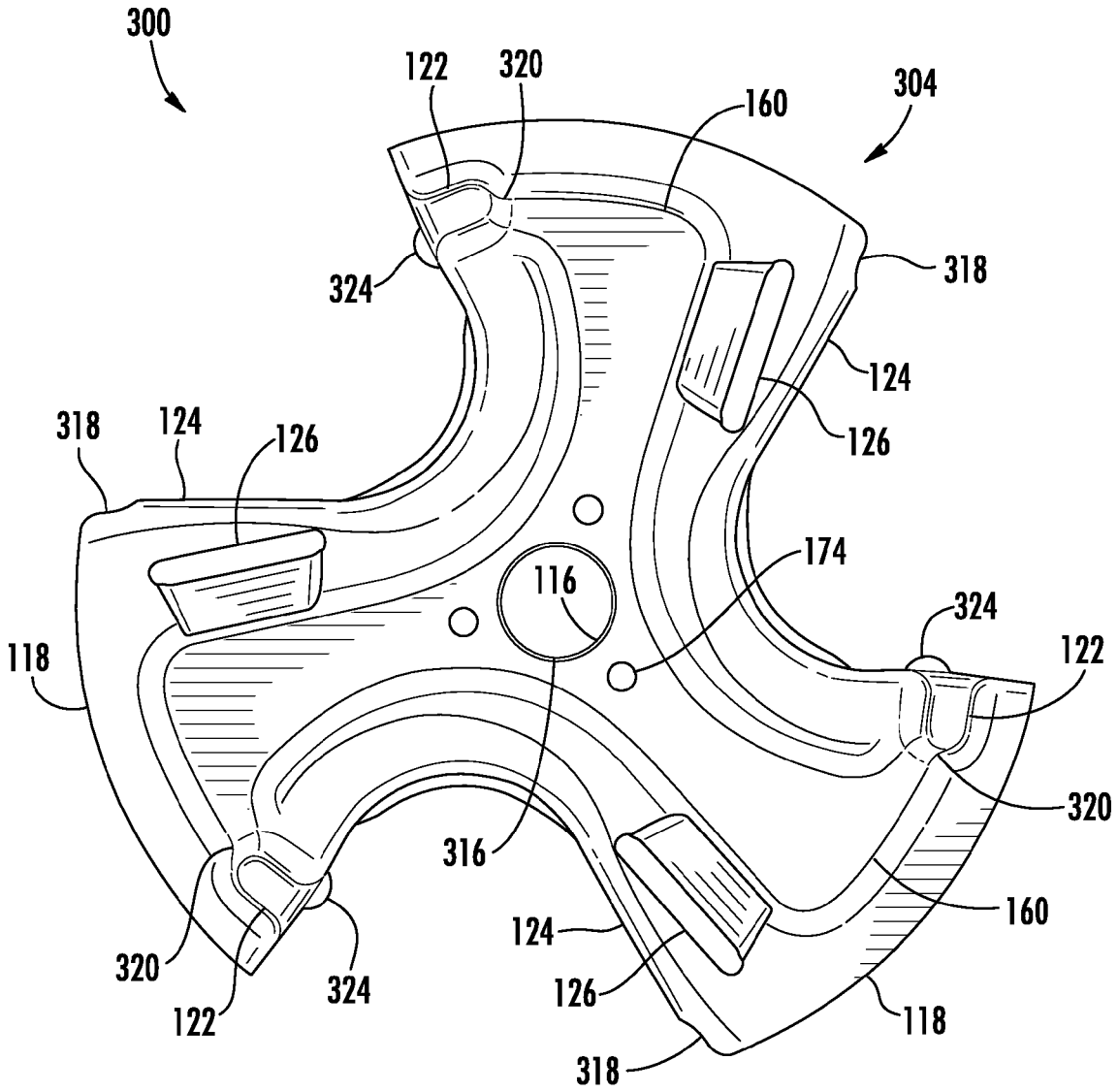
FIG. 15 is a rear plan view of the impeller of FIG. 11.

Intermediate depression channels 320, ribs 324, tapers 326 and chamfers 328 cooperate to control deformation or bending of blade 120 of shovels 112 when shovels 112 encounter non-snow obstructions that may wedge between impeller 300 and impeller housing 36 (shown in FIG. 1) while impeller rotates at a speed of at least 1200 revolutions per minute. Depression channels 320 comprises channels or depressions extending between and interconnecting depressions 160 and depression gussets 122. As shown by FIGS. 15, each depression channel 320 extends within rear side 304 of impeller 300 (such that channel 320 has a concave side on rear side 304 and a convex side on front side 302 (shown in FIG. 11). Depression channels 320 further strengthen the junction between blade support walls 118 and their associated blades 120. In other implementations, depression channel 320 may be omitted.

Figure 16:
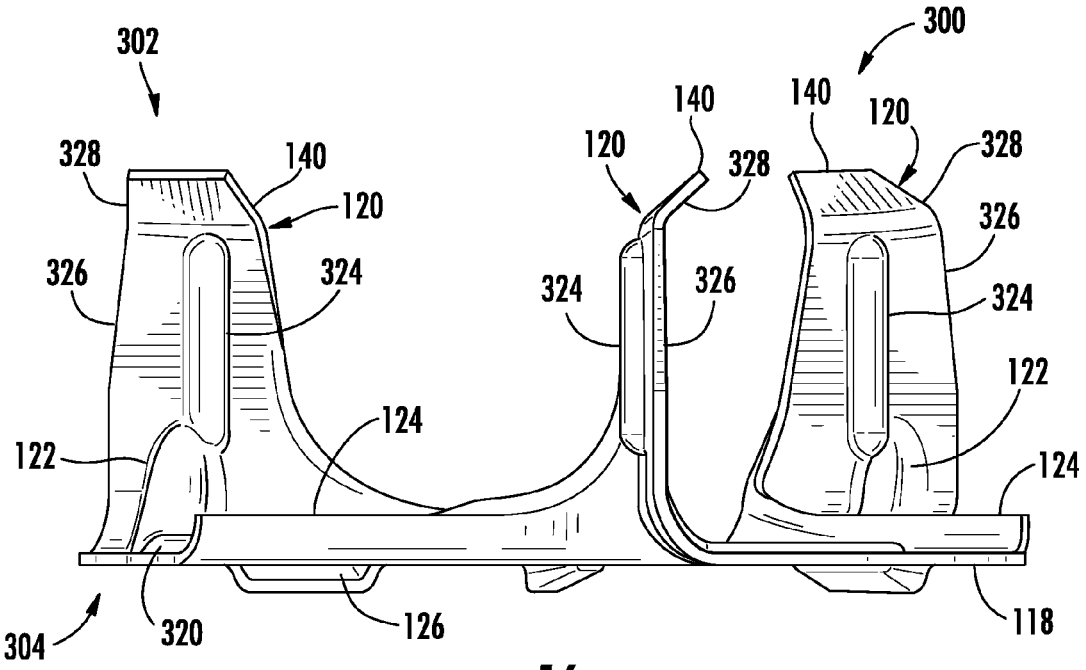
FIG. 16 is a side elevational view of the impeller of FIG. 11.
Figure 17:
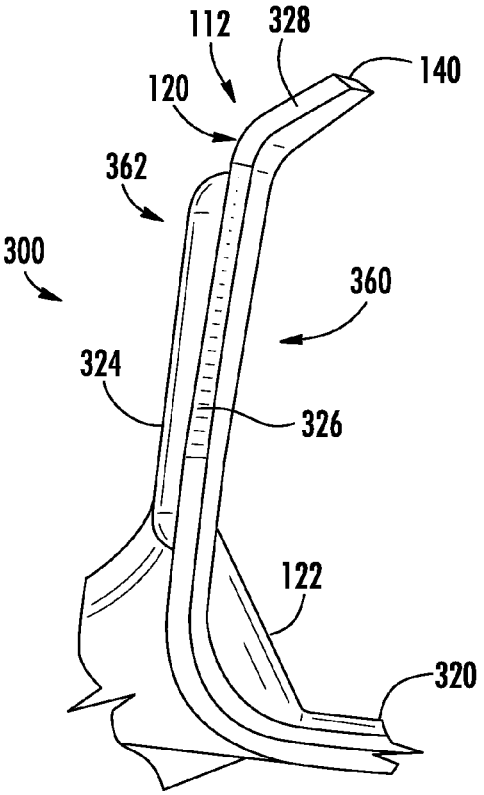
FIG. 17 is an enlarged fragmentary side elevational view of the impeller of FIG. 11.

As shown by FIGS. 11 and 16-17, ribs 324 comprise blade strengthening structures or reinforcements extending between depression gussets 120 and tip portion 140. Ribs 324 strengthen or reinforce those portions of each blade 120 between depression gusset 122 and tip portion 140. Although impeller 300 is illustrated as including a single rib 324 in each blade 120, in other implementations, each blade 120 may include multiple spaced ribs 324 between depression gusset 122 and tip portion 140.

In the example illustrated, ribs 324 each comprise an embossed channel having a first end portion 354 proximate depression gusset 122 and a second opposite end 356 proximate to a base of tip portion 140. In the example illustrated, each rib 324 is formed by embossing the existing layer of material, rather than adding structures or material to impeller 300 which might otherwise increase cost and complexity. Each rib 324 forms a channel with a concave surface on the snow driving face 360 of each shovel 112 and a corresponding convex bulbous projecting surface on a rear face 362 of each shovel 112. In other implementations, each rib 324 may alternatively be formed by adding material to each blade 120 or may have other shapes or configurations. In some implementations, ribs 324 may be omitted.

Tapers 326 and chamfers 328 comprise angled portions along a radial outermost edges of blade 120. Tapers 326 and chamfers 320 provide additional clearance between the radial outermost edges of blade 20 and the inner surfaces of impeller housing 36 (shown in FIG. 1) to reduce the likelihood that the outermost edge of blade 20 will lock up with impeller housing 36 or the opening of discharge chute 38 along impeller housing 36 so as to impede or interfere with the rotation of impeller 300. Tapers 326 and chamfers 320 further provide clearance to allow non-snow obstructions to pass between the outermost edge of blade 20 and the interior of impeller housing 36. For purposes of this disclosure, the term "non-snow obstructions" refers to rigid objects that will not break down or break up in response to being pinched between impeller 300 and impeller housing 36. During rotation of impeller 300. Examples of such non-snow obstructions include gravel, rocks, ice chunks and the like.

Figure 18:
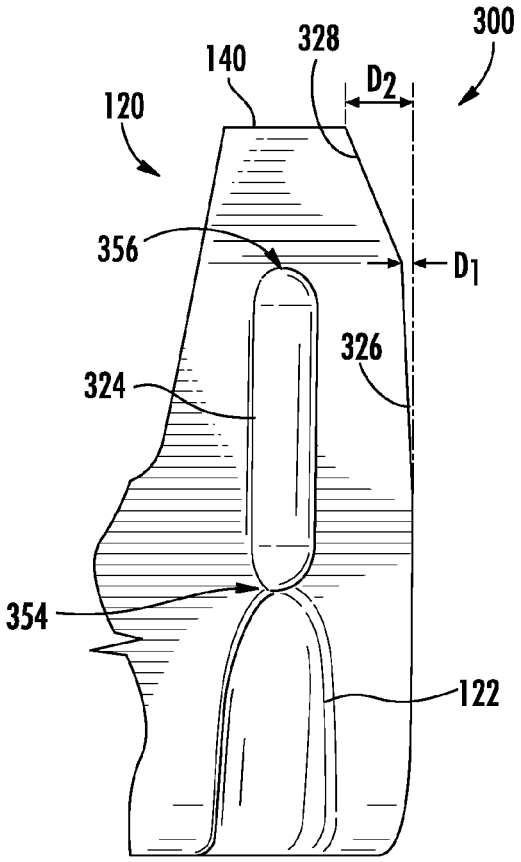
FIG. 18 is another enlarged fragmentary side elevational view of the impeller of FIG. 11.

FIG. 18 illustrates one of tapers 326 and one of chamfers 328. As shown by FIG. 18, each taper 326 is an edge of blade 112 that angles or slopes radially inward. Each chamfers 328 is an edge of tip portion. 140 that angles or slopes radially inward. In one implementation, each taper 326 starts at an approximate midpoint of blade 112 (between wall 118 and a base of tip portion 140) and angular slopes to a distance D1 offset from vertical of between 0.075 inches and 0.250 inches. For example, in one implementation, impeller 300 has a diameter of about 12 inches and a paddle or shovel height (from wall 118 to a top of tip portion 140) of about 3 inches, wherein taper 326 tapers from a midpoint of the blade 120 to an offset distance D1 of 0.100 inches (over a taper length of 2 inches). In one implementation, impeller 300 has a diameter of 10 inches with a panel or shovel height of 2.75 inches, wherein taper 326 tapers from a midpoint of the blade. 120 to an offset distance D1 of 0.075 inches. In another implementation, impeller 300 has a diameter of 14 inches and a blade height of 3.5", wherein taper 326 tapers from a midpoint of the blade 122 and offset distance D1 of 0.250 inches.

Chamfer 328 is an outermost radial edge of tip portion 140 that tapers inward at an angle of between 35 and 55 degrees (nominally 45 degrees) to an offset distance D2 spaced from vertical of between 5/16 of an inch and ½ of an inch.

Such angles and offset distances for tapers 326 and chamfers 328 provide sufficient clearance for impeller 300 when encountering non-snow obstructions and rotating a speed of at least 1200 RPM when impeller 300 is formed from a layer of low carbon steel (10% carbon or less) having a thickness of between 0.110 inches and 0.1504 inches. In other implementations, chamfer 328 may extend at other angles and provide other offset distances D2 depending upon a diameter of impeller 300, a height of the paddles or shovels 112 and material from which impeller 300 is formed. Likewise, in other implementations, chamfer 328 may extend at other angles and provide other offset distances D2 depending upon a diameter of impeller 300, a height of the paddles or shovels 112 and material from which impeller 300 is formed.

Figure 19:
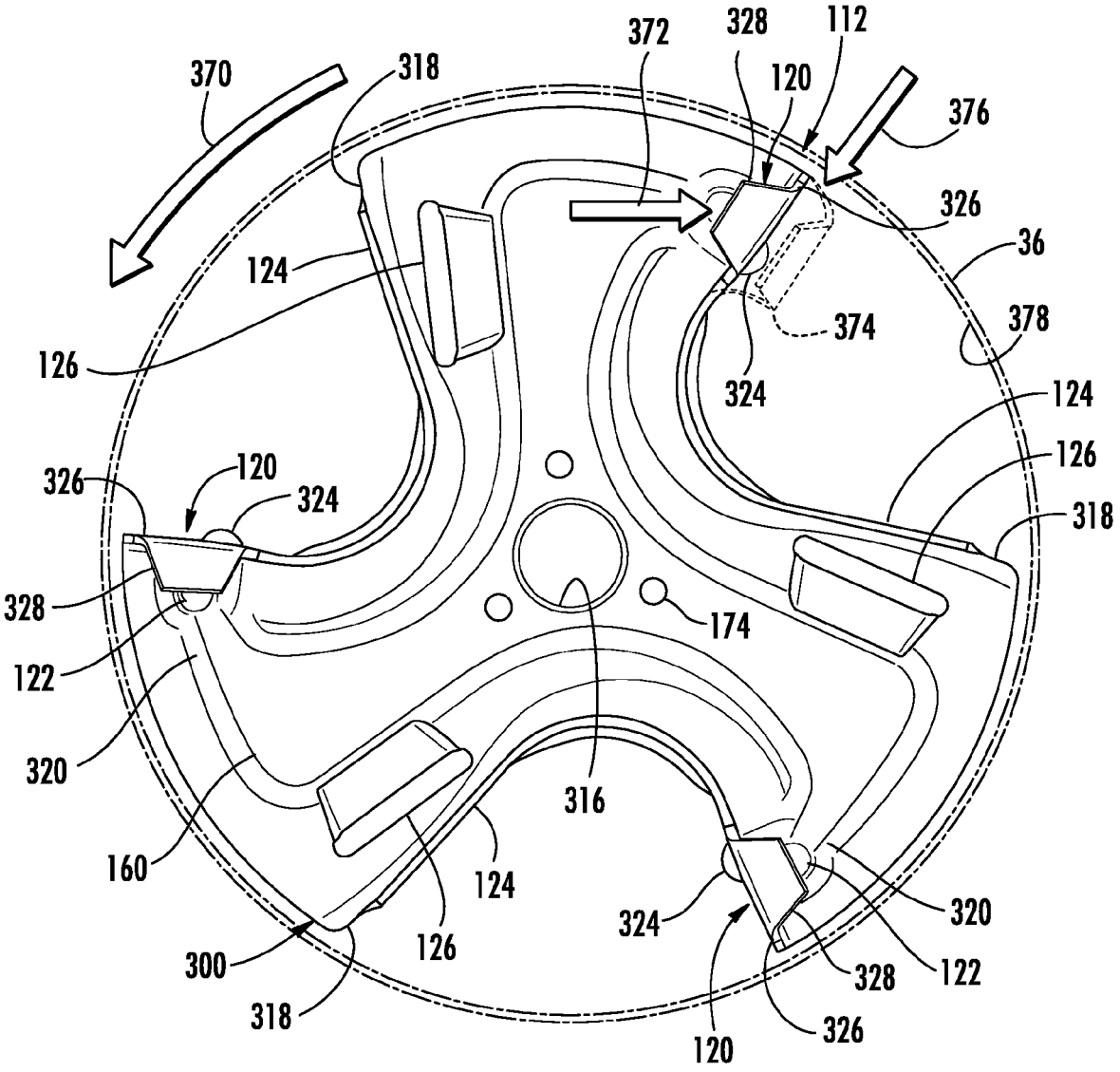
FIG. 19 is a front elevational view of the impeller FIG. 11 in an impeller housing illustrating deformation of a blade of the impeller in broken lines.

FIG. 19 illustrates bending of an example impeller 300 within impeller housing 36 (sometimes referred to as an impeller can) when encountering a lodged non-snow obstructions while rotating a speed of at least 1200 RPM. As shown by FIG. 19, impeller 300 is rotatably driven in the direction indicated by arrow 370. Upon encountering a non-snow obstructions during such rotation, a blade 120 of one of shovels 112 may bend in a general direction indicated by arrow 372 to the bent position 374 (shown in broken lines). As noted above, depressions, 320 and ribs 324 cooperate to control such bending, increasing a likelihood that blade 120, upon encountering obstruction, will at least stay within the original outer diameter of impeller 300 and nominally bend or deform radially inward in the direction indicated by arrow 376 to allow the non-snow obstructions to pass between the blade 120 and the internal surface 378 of impeller housing 36. As noted above, taper 326 and chamfer 328 provide additional radial clearance between blade 120 and interior surface 378 to further assist passing of the non-snow obstruction.

In one implementation, impeller 300 is formed from a single stamped and embossed or bent sheet of metal having material properties that allow it to be stamped, bent, deformed and embossed into the above noted shapes, that offer sufficient strength to move and impel snow and that allow it to bend without shattering or cracking when encountering non-snow obstructions and rotating at least at 1200 RPM. Impeller 300 is formed from a single sheet of low carbon steel having a thickness of between 0.110 inches and 0.154 inches. For example, in one implementation, impeller 300 may be formed from ASTM A1008, DS Type B. In one implementation, impeller 300 has a diameter of approximately inches and is formed from 9 gauge low carbon steel. In another implementation, impeller 300 has a diameter of 10 inches and is formed from 10 gauge low carbon steel. In yet another implementation, impeller 300 has a diameter of about 14 inches and is formed from 8 gauge low carbon steel.

Figure 20:
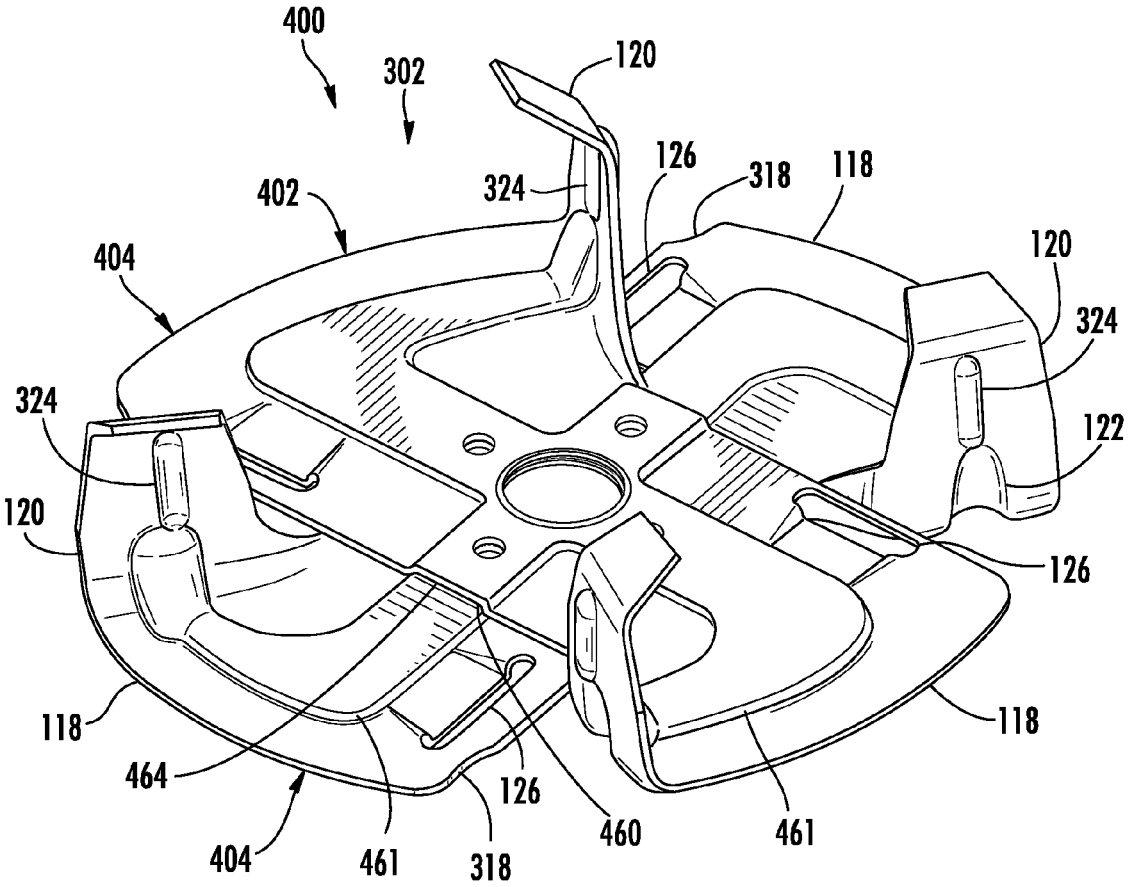
FIG. 20 is a front perspective view of another example of the impeller of FIG. 4.
Figure 21:
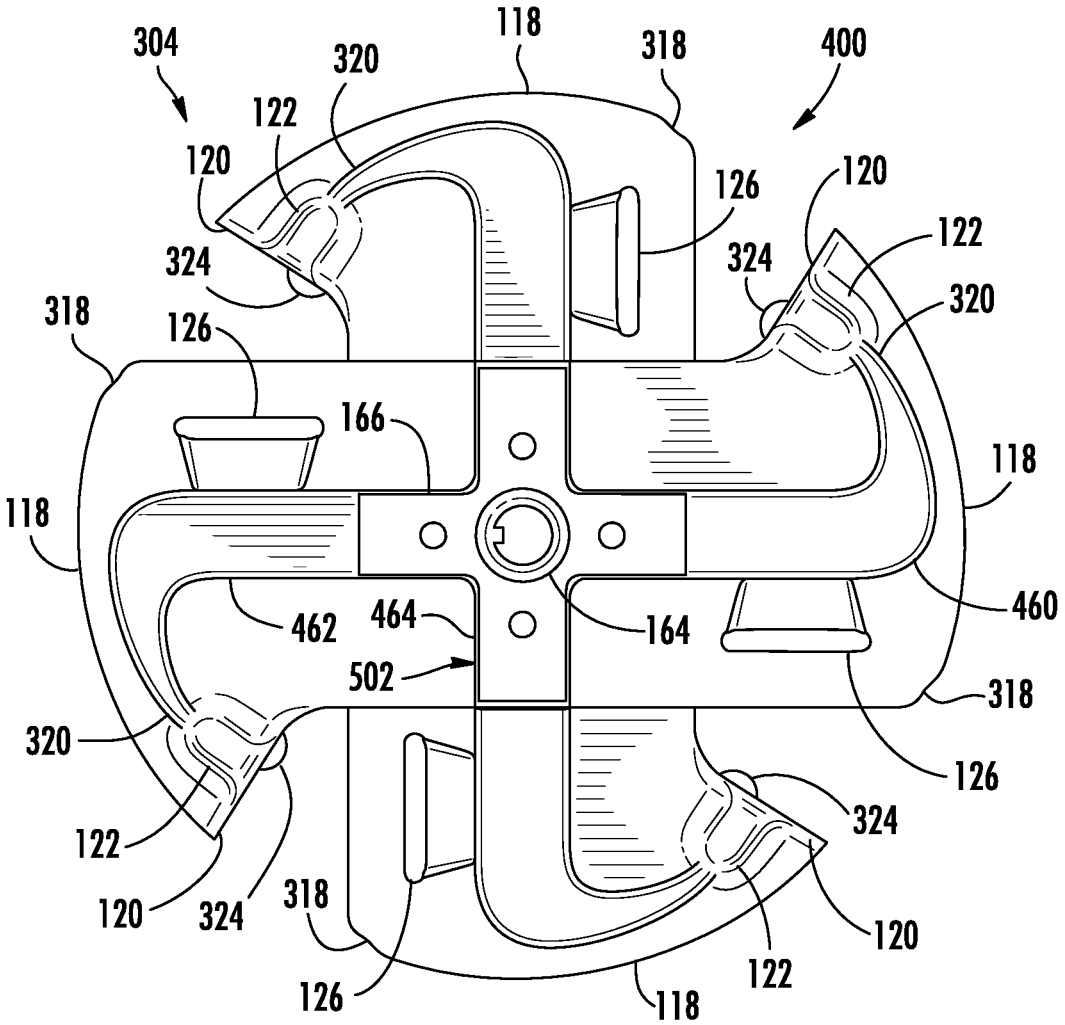
FIG. 21 is a rear plan view of an example impeller assembly including the impeller of FIG. 20.
Figure 22:
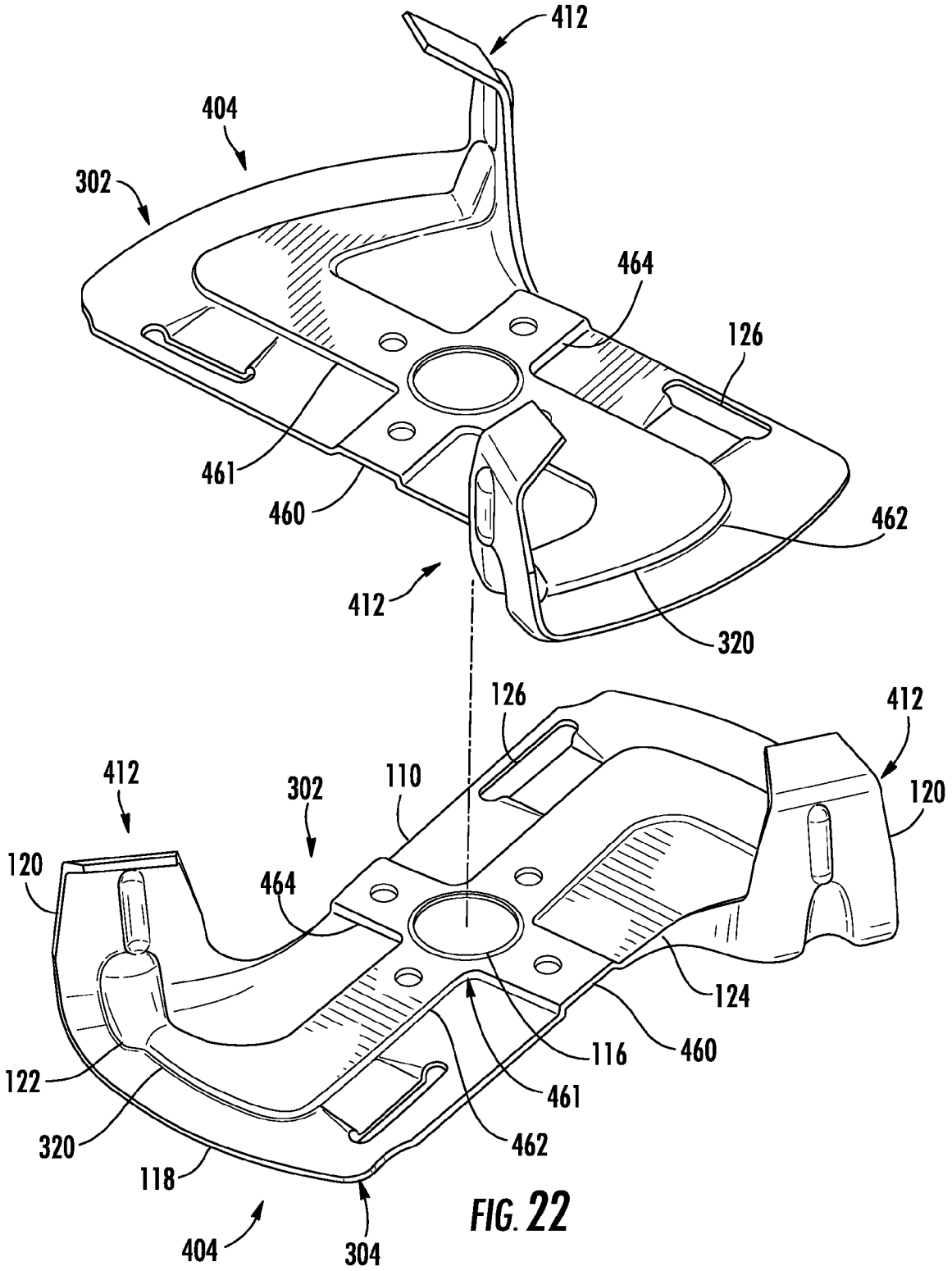
FIG. 22 is an exploded front perspective view of the impeller of FIG. 20.

FIGS. 20-23 illustrate impeller 400, another example implementation of an impeller 100. As shown by FIGS. 20 and 21, impeller 400 is formed from a stack 402 of multiple individual impellers 404. In the example illustrated, each of impellers 404 is identical, facilitating lower-cost production and assembly. As shown by FIG. 22, each impeller 404 is similar to impeller 300 except that each impeller 404 comprises two, rather than three, shovels 412 and comprises noncircular depression 460 in place of noncircular depression 160.

Each of shovels 412 are similar to shovels 112 of impeller 300 except that the blade supporting walls 118 of shovels 412 extends opposite to one another from opposite sides of aperture 116, 180 degrees apart from one another and that web 124 of each blade 120 terminates at or prior to reaching noncircular depression 460.

Noncircular depression 460 is similar to noncircular depression 160 in that noncircular depression 460 extends into central portion 110 and extends outwardly from central portion 110 and from aperture 116. As with noncircular depression 160, noncircular depression 460 comprises a bent, deformed or embossed portion of the layer such that noncircular depression 160 comprises a depression or cavity on rear side 304 and has a corresponding or mirroring raised or elevated portion 461 on front side 302. In other implementations, the embodiment may be reversed such that the raised portion extends on rear side 304 while the depressed portion extends on front side 302.

In the example implementation illustrated, noncircular depression 460 comprises elongate portions 462 and a short portions 464. Elongate portions 462 extend radially outward from aperture 116 along each blade supporting wall 118. As with noncircular depression 160, elongate portions 462 of noncircular depression 460 are connected to depression gussets 122 of blades 120 by the intermediate depression channel 320.

Short portions 464 radially extend outwardly from aperture 116 perpendicular to elongate portions 462. As shown by FIG. 20, short portions 464 form a depression that receives the raised portion 461 of elongate portions 462 when individual impellers 404 are stacked. Short portions 464 further form raised portions or projections 461 on an opposite side of impeller 404 which are received within the depressed portions of elongate portion 462 when the impellers 404 are stacked. As a result, impellers 404 interlock with one another and are keyed relative to one another to facilitate a stronger interconnection and accurate angular positioning of impellers 404 with respect to one another.

As shown by FIG. 21, the depressions provided by elongate portions 462 and short portions 464 of the rearward most or bottom most impeller 404 receive a shaft coupler 502. Shaft coupler 502 is similar to shaft coupler 102 except that the shaft coupler 502 comprises a hub 164 with key portions 166 including four, rather than three, fingers or extensions which are received within elongate portions 462 and short portions 464 to key shaft coupler 502 to impeller 400.

Figure 23:
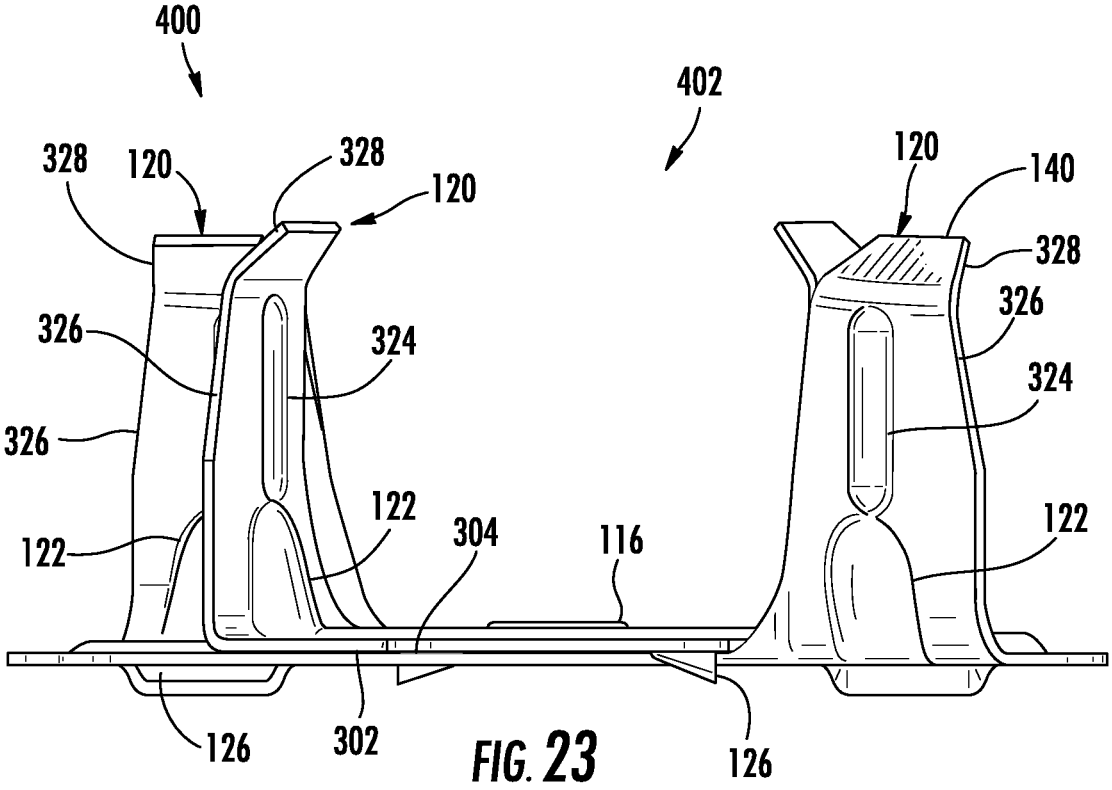
FIG. 23 is a side elevational view of the impeller of FIG. 20.

Moreover, as shown by FIG. 23, front side 302 of the lower most impeller 404 lies flush against or contacts rear side 304 of the uppermost impeller 404 (as seen in FIG. 22) during such stacking Because short portions 464 facilitate a larger surface area of contact between impellers 404, the assembled impeller 400 is stronger and more durable. Any reduction of strength resulting from the omission or shortening of webs 124 is compensated by the overlapping multiple layers of impellers 404.

In the example implementation, impeller 400 is illustrated as being formed from two impellers 404 annually offset from one another by 180 degrees. In other implementations, impeller 400 may be formed from more than two impellers 404 to provide greater than four shovels 412 and blades 120. In such implementations, the relative angles between short portion 464 and elongate portions 462 of non-circular depression 460 may be appropriately established to achieve symmetry about aperture 116. In other implementations, impellers 404 may alternatively be configured so as to not key to one another. In some implementations, impeller 400 may be formed from dissimilar impellers 400 which are stacked. In yet other implementations, impeller 400 may be formed by multiple impellers 404 (each impeller 404 having two or more shovels) which are not stacked adjacent to and upon one another, but which are each supported proximate to one another, being mounted to and rotationally supported by a single shaft or multiple axially aligned shafts.

Figure 24:
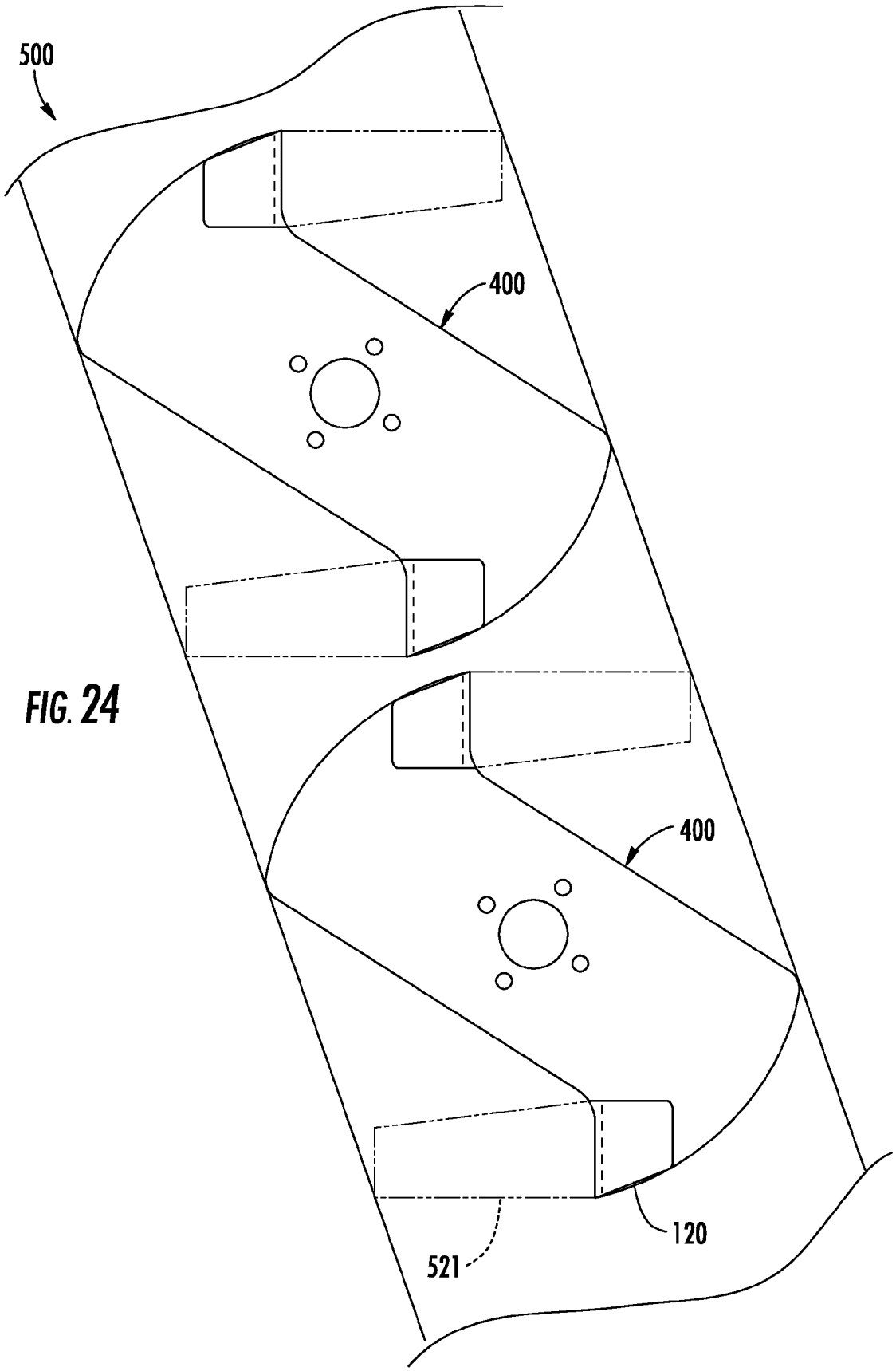
FIG. 24 is a top view of an example stamping layout for forming impellers.

FIG. 24 is a diagram illustrating an example stamping layout 500 for forming impellers. In particular, FIG. 24 illustrates an arrangement orientation of impellers 400 for being stamped or cut from a single sheet or layer of material. As shown by FIG. 24, blades 120 are formed by bending or deforming stamped portions 521. The remaining structures of each impeller 400 by subsequently formed by additional stamping and embossing steps.

In other embodiments, other materials or thicknesses may be employed for forming impeller 100. As with impeller 300, impeller 400 is formed from a single stamped and embossed or bent sheet of metal having material properties that allow it to be stamped, bent, deformed and embossed into the above noted shapes, that offer sufficient strength to move and impel snow and that allow it to bend without shattering or cracking when encountering non-snow obstructions and rotating at least at 1200 RPM. Impeller 400 is formed from a single sheet of low carbon steel having a thickness of between 0.110 inches and 0.154 inches. For example, in one implementation, impeller 300 may be formed from ASTM A1008, DS Type B. In one implementation, impeller 400 has a diameter of approximately inches and is formed from 9 gauge low carbon steel. In another implementation, impeller 300 has a diameter of 10 inches and is formed from 10 gauge low carbon steel. In yet another implementation, impeller 400 has a diameter of about 14 inches and is formed from 8 gauge low carbon steel.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A snow thrower comprising:

an engine;

an auger housing configured to receive a snow;

an auger within the auger housing and operably coupled to the engine so as to be driven by the engine;

an impeller housing configured to receive snow driven by the auger from the auger housing;

a discharge chute extending from the impeller housing; and an impeller within the impeller housing and operably coupled to the engine so as to be driven by the engine to discharge snow from the impeller housing through the discharge chute, the impeller comprising:

a layer of material having bent portions such that the layer of material comprises a plurality of shovels, each of the plurality of shovels comprising:

a blade support wall having a leading portion and a trailing portion; and a blade having a base extending from the trailing portion of the blade support wall, wherein each of the blades has a snow driving face, the snow driving face of each blade facing in a direction about the rotation axis of the impeller, wherein the blade is independently upright with respect to the blade support wall so as to be connected to the impeller solely at the base of the blade to form an unobstructed snow receiving volume between a rear face of the shovel and the snow driving face of a trailing blade.

2. The snow thrower of claim 1, wherein each of the blades has an outermost radial tip with a blade edge, the blade edge having a first radially inward taper.

3. The snow thrower of claim 2, wherein each blade comprises an angled top having a radially outermost top edge, the top edge having a chamfer.

4. The snow thrower of claim 1, wherein each blade comprises an angled top having a radially outermost top edge, the top edge having a chamfer.

5. The snow thrower of claim 1, wherein each blade is configured to bend inwardly and rearwardly when encountering non-snow obstructions while rotating a speed of at least 1200 revolutions per minute.

6. The snow thrower of claim 1, wherein each of the blades has a recessed portion proximate an outermost tip of the blade, the recessed portion facing and recessed from a plane that contains the rotational axis of the impeller and that extends from the rotational axis tangent to the snow driving face.

7. The snow thrower of claim 6, wherein the recessed portion is concave.

8. The snow thrower of claim 6, wherein the recessed portion has a radius of curvature of between 16 inches and 22 inches.

9. The snow thrower of claim 6, wherein the snow driving face includes a convex portion between the recessed portion and the rotational axis of the impeller.

10. The snow thrower of claim 1, wherein each of the blades has a snow driving face, the snow driving face of each blade facing in a direction about the rotation axis of the impeller and wherein the impeller further comprises louvers extending through the blade support wall, each louver facing in the direction.

11. The snow thrower of claim 10 further comprising a web along the leading portion of the blade support wall, the web terminating at a notch extending from the web to an outer radial end of the blade support wall.

12. The snow thrower of claim 10, wherein each of the blades project from a first side of the blade support wall and wherein the louvers have fins projecting from a second side of the blade support wall opposite the first side.

13. The snow thrower of claim 1 further comprising a depression gusset in the snow driving face of each blade and extending from the blade to the blade support wall, each depression gusset having a maximum inside diameter of between 0.4 inches and 0.8 inches and a height measured perpendicularly from the blade support wall of between 1.5 inches and 1.9 inches.

14. The snow thrower of claim 1, wherein the impeller further comprises:

an aperture through the layer; and a non-circular depression in the layer about the aperture;

wherein the snow thrower further comprises a shaft coupler comprising:

a hub received within the aperture and configured to mount to a shaft; and key portions extending from the hub and received within the non-circular depression so as to key the hub to the impeller.

15. The snow thrower of claim 1, wherein each of the blades has a snow driving face and wherein the snow thrower further comprises a web extending and tapering from the snow driving face of each blade to a perimeter of the blade support wall.

16. The snow thrower of claim 15, wherein the web has a concave side facing away from the rotational axis of the impeller.

17. The snow thrower of claim 1, wherein each of the blades has a snow driving face and wherein each blade has a top portion extending oblique from the snow driving face.

18. The snow thrower of claim 1, wherein the blade support wall extends along a base of the snow driving face and projects in the direction from the snow driving face.

19. The snow thrower of claim 1, wherein the layer of material comprises three shovels spaced 120° about a rotational axis of the impeller with no other shovels between the three shovels, each shovel having a blade with a height measured perpendicularly from the blade support wall of at least 2.5 inches.

20. The snow thrower of claim 1 further comprising a second layer of material, the second layer of material having bent portions such that the second layer of material comprises a second plurality of shovels, each of the second plurality of shovels comprising:

a second blade support wall having a leading portion and a trailing portion; and a second blade extending from the leading portion of the second blade support wall, wherein the second layer overlies the first layer and is angularly offset from the first layer to form the impeller having at least four shovels.

21. The snow thrower of claim 20, wherein the first layer comprises a first shovel and a second shovel angularly spaced 180° from the first shovel, wherein the second layer comprises a third and a fourth shovel angularly spaced 180° from the third shovel, wherein the first shovel and the second shovel are angularly spaced from one another by 90°.

22. The snow thrower of claim 20, wherein the first layer includes a noncircular raised portion and wherein the second layer includes a non-circular depression receiving the noncircular raised portion.

23. The snow thrower of claim 22, wherein the second layer further comprises:

a depression gusset extending between the second blade support wall and the second blade of each of the second plurality of shovels, wherein the noncircular depression comprises:

a first portion interconnecting the depression gusset of a first one of the second plurality of shovels and the depression gusset of a second one of the plurality of shovels; and a second portion extending from the first portion perpendicular to the first portion.

24. The snow thrower of claim 1, wherein the layer of material comprises a 9 gauge low carbon steel.

25. The snow thrower of claim 1, wherein the layer of material comprises a 10 gauge low carbon steel.

26. The snow thrower of claim 1, wherein the layer of material comprises an 8 gauge low carbon steel.

27. The snow thrower of claim 10 further comprising a web along the leading portion of the blade support wall on a same side of the impeller as the snow driving face, the web extending from one of the blades and terminating opposite one of the louvers.

28. A snow thrower comprising:

an engine;

an auger housing configured to receive a snow;

an auger within the auger housing and operably coupled to the engine so as to be driven by the engine;

an impeller housing configured to receive snow driven by the auger from the auger housing;

a discharge chute extending from the impeller housing;

an impeller within the impeller housing and operably coupled to the engine so as to be driven by the engine to discharge snow from the impeller housing through the discharge chute, the impeller comprising:

a layer of material formed from cold rolled steel having a thickness of between 0.110 inches and 0.154 inches, the layer having bent portions such that the layer of material comprises a plurality of shovels, each of the plurality of shovels comprising:

a blade support wall having a leading portion and a trailing portion; and a blade extending from the trailing leading portion of the blade support wall;

an aperture through the layer;

a non-circular depression in the layer about the aperture;

a depression gusset in the snow driving face of each blade and extending from the blade to the blade support wall; and an intermediate depression channel in the layer of material connecting an interior of the depression gusset to an interior of the non-circular depression; and a shaft coupler comprising:

a hub received within the aperture and configured to mount to a shaft; and key portions extending from the hub and received within the non-circular depression so as to key the hub to the impeller.

29. The snow thrower of claim 28 further comprising an embossed rib in each blade and extending from the depression gusset towards a top of the blade, wherein the depression gusset forms a channel on a face of the blade opposite the snow driving face and wherein the embossed rib forms a channel on the snow driving face.

30. The Snow thrower of claim 28 further comprising fasteners extending through the layer into the key portions.

31. The snow thrower of claim 14, wherein the shaft coupler comprises a corner joint interconnecting the hub and the key portions and wherein the impeller further comprises a secondary depression about the aperture receiving the corner joint of the hub such that a face of the key portions lie flush against a floor of the non-circular depression.

32. A snow thrower impeller comprising:

a layer of material having deformed portions such that the layer of material comprises:

a central portion about a rotational axis of the impeller;

a plurality of shovels extending from the central portion, each shovel comprising:

a blade having a snow driving face facing in a direction;

a depression gusset in each blade, the depression gusset forming a first channel on a face of the blade opposite the snow driving face;

an embossed rib in each blade and extending from the depression gusset towards a top of the blade, the embossed rib forms a second channel on the snow driving face; and a blade support wall extending along a base of the snow driving face and projecting in the direction from the snow driving face, wherein the blade is independently upright with respect to the blade support wall to as to be connected to the impeller solely at the base of the blade.

33. The snow thrower impeller of claim 32, wherein each of the blades has an outermost radial tip with a blade edge, the blade edge having a first radially inward taper.

34. The snow thrower impeller of claim 33, wherein each blade comprises an angled top having a radially outermost top edge, the top edge having a chamfer.

35. The snow thrower impeller of claim 32, wherein each blade comprises an angled top having a radially outermost top edge, the top edge having a chamfer.

36. The snow thrower impeller of claim 32, wherein each blade is configured to bend inwardly and rearwardly when encountering non-snow obstructions while rotating a speed of at least 1200 revolutions per minute.

37. The snow thrower impeller of claim 32, wherein each of the blades has a snow driving face, the snow driving face of each blade facing in a direction about the rotation axis of the impeller and wherein the impeller further comprises louvers extending through the blade support wall, each louver facing in the direction.

38. The snow thrower impeller of claim 37 further comprising a web along a leading ortion of the blade support wall on a same side of the impeller as the snow driving face, the web extending from one of the blades and terminating opposite one of the louvers.

39. The snow thrower impeller of claim 32 further comprising a web along the leading portion of the blade support wall, the web terminating at a notch extending from the web to an outer radial end of the blade support wall.

40. A snow thrower impeller comprising:

a layer of material having deformed portions such that the layer of material comprises:

a central portion about a rotational axis of the impeller; and a plurality of shovels extending from the central portion, each shovel comprising:

a blade having a snow driving face facing in a direction;

a blade support wall extending along a base of the snow driving face and projecting in the direction from the snow driving face;

a second layer of material the second layer having bent portions such that the second layer of material comprises a second plurality of shovels, each of the second plurality of shovels comprising:

a second blade support wall having a leading portion and a trailing portion; and a second blade extending from the leading portion of the second blade support wall, wherein the second layer overlies the first layer and is angularly offset from the first layer to form the impeller having at least four shovels.

41. The snow thrower of claim 40, wherein the first layer comprises a first shovel and a second shovel angularly spaced 180° from the first shovel, wherein the second layer comprises a third and a fourth shovel angularly spaced 180° from the third shovel, wherein the first shovel and the second shovel are angularly spaced from one another by 90°.

42. A snow thrower comprising:

an engine;

an auger housing configured to receive a snow;

an auger within the auger housing and operably coupled to the engine so as to be driven by the engine;

an impeller housing configured to receive snow driven by the auger from the auger housing;

a discharge chute extending from the impeller housing; and an impeller within the impeller housing and operably coupled to the engine so as to be driven by the engine to discharge snow from the impeller housing through the discharge chute, the impeller comprising:

a layer of material formed from cold rolled steel having a thickness of between 0.110 inches and 0.154 inches, the layer having bent portions such that the layer of material comprises a plurality of shovels, each of the plurality of shovels comprising:

a blade support wall having a leading portion and a trailing portion; and a blade extending from the trailing portion of the blade support wall;

an aperture through the layer; and a non-circular depression in the layer about the aperture;

wherein the snow thrower further comprises a shaft coupler comprising:

a hub received within the aperture and configured to mount to a shaft; and key portions extending from the hub and received within the non-circular depression so as to key the hub to the impeller, wherein the shaft coupler comprises a corner joint interconnecting the hub and the key portions and wherein the impeller further comprises a secondary depression about the aperture receiving the corner joint of the hub such that a face of the key portions lie flush against a floor of the non-circular depression.

43. A snow thrower impeller comprising:

a layer of material having deformed portions such that the layer of material comprises:

a central portion about a rotational axis of the impeller; and a plurality of shovels extending from the central portion, each shovel comprising:

a blade having a snow driving face facing in a direction;

a blade support wall extending along a base of the snow driving face and projecting in the direction from the snow driving face;

a depression gusset in each blade, the depression gusset forming a first channel on a face of the blade opposite the snow driving face; and an embossed rib in each blade and extending from the depression gusset towards a top of the blade, the embossed rib forms a second channel on the snow driving face.

* * * * *